US006422979B1

(12) United States Patent
Krull

(10) Patent No.: US 6,422,979 B1
(45) **Date of Patent: *Jul. 23, 2002**

(54) WEIGHT SELECTION METHODS FOR ADJUSTING RESISTANCE TO EXERCISE

(76) Inventor: Mark A. Krull, 1705 E. Ridge Ct., Northfield, MN (US) 55057

( * ) Notice: Subject to any disclaimer, the term of this patent is extended or adjusted under 35 U.S.C. 154(b) by 0 days.

This patent is subject to a terminal disclaimer.

(21) Appl. No.: 09/300,546

(22) Filed: Apr. 27, 1999

Related U.S. Application Data

(63) Continuation-in-part of application No. 09/259,732, filed on Mar. 1, 1999, now Pat. No. 6,186,927, which is a continuation of application No. 08/886,607, filed on Jul. 1, 1997, now Pat. No. 5,876,313.

(60) Provisional application No. 60/022,196, filed on Jul. 19, 1996, provisional application No. 60/108,768, filed on Nov. 17, 1998, and provisional application No. 60/119,014, filed on Feb. 8, 1999.

(51) Int. Cl.[7] ..... A63B 21/062; A63B 21/075

(52) U.S. Cl. ..... 482/98; 482/99; 482/107; 482/108

(58) Field of Search ..... 482/93, 94, 98, 482/99, 106–109

(56) References Cited

U.S. PATENT DOCUMENTS

| | | | | |
|---|---|---|---|---|
| 3,647,209 A | | 3/1972 | La Lanne | 482/103 |
| RE31,113 E | | 12/1982 | Coker et al. | 482/98 |
| 4,540,171 A | | 9/1985 | Clark et al. | 482/98 |
| 4,568,078 A | | 2/1986 | Weiss | 482/100 |
| 4,624,457 A | | 11/1986 | Silberman et al. | 482/98 |
| 4,730,828 A | | 3/1988 | Lane | 482/98 |
| 4,878,662 A | | 11/1989 | Chern | 482/98 |
| 5,221,244 A | | 6/1993 | Doss | 482/106 |
| 5,306,221 A | | 4/1994 | Itaru | 482/98 |
| 5,669,861 A | | 9/1997 | Toups | 482/98 |
| 5,839,997 A | | 11/1998 | Roth et al. | 482/107 |
| 5,876,313 A | * | 3/1999 | Krull | 482/98 |

FOREIGN PATENT DOCUMENTS

| | | | | |
|---|---|---|---|---|
| EP | 177643 | | 4/1986 | 482/99 |
| FR | 2613237 | | 10/1988 | 482/99 |
| SU | 1258447 | * | 9/1986 | 482/93 |

* cited by examiner

*Primary Examiner*—Jerome W. Donnelly
*Assistant Examiner*—Victor Hwang

(57) ABSTRACT

A selector rod is rotated into engagement with each desired weight plate in a stack to provide adjustable resistance to exercise movement. On a first embodiment, the selector rod extends vertically and is movable axially relative to a vertical stack of weights. On a second embodiment, the selector rod extends horizontally and is movable radially relative to a horizontal stack of weight plates.

30 Claims, 22 Drawing Sheets

WEIGHT SELECTION METHODS FOR ADJUSTING RESISTANCE TO EXERCISE

CROSS-REFERENCE TO RELATED APPLICATIONS

This application is a continuation-in-part of U.S. patent application Ser. No. 09/259,732, filed on Mar. 1, 1999, now U.S. Pat. No. 6,186,927 which is a continuation of U.S. patent application Ser. No. 08/886,607, filed on Jul. 1, 1997, now U.S. Pat. No. 5,876,313, and also discloses subject matter entitled to the earlier filing date of U.S. Provisional Application No. 60/022,196, filed on Jul. 19, 1996; and this application also discloses subject matter entitled to the earlier filing dates of U.S. Provisional Application No. 60/108,768, filed on Nov. 17, 1998, and U.S. Provisional Application No. 60/119,014, filed on Feb. 8, 1999.

FIELD OF THE INVENTION

The present invention relates to exercise equipment and more particularly, to weight selection methods and apparatus.

BACKGROUND OF THE INVENTION

Various weight selection methods and apparatus have been developed to provide adjustable resistance to exercise. In the case of exercise weight stacks, for example, several weight plates are arranged in a vertical stack and maintained in alignment by rods or other guide members. A desired amount of weight is engaged by selectively connecting a selector rod to the appropriate weight plate in the stack. The selector rod and/or the uppermost weight in the stack are/is connected to at least one force receiving member by means of a connector. The engaged weights are lifted up from the stack in response to movement of the force receiving member.

Some examples of patented weight stack improvements and/or features are disclosed in U.S. Pat. No. 3,912,261 to Lambert, Sr. (discloses an exercise machine which provides weight stack resistance to a single exercise motion); U.S. Pat. No. 5,263,915 to Habing (discloses an exercise machine which uses a single weight stack to provide resistance to several different exercise motions); U.S. Pat. No. 4,900,018 to Ish III, et al. (discloses an exercise machine which provides weight stack resistance to a variety of exercise motions); U.S. Pat. No. 4,878,663 to Luquette (discloses an exercise machine which has rigid linkage members interconnected between a weight stack and a force receiving member); U.S. Pat. No. 4,601,466 to Lais (discloses bushings which are attached to weight stack plates to facilitate movement along conventional guide rods); U.S. Pat. No. 5,374,229 to Sencil (discloses an alternative to conventional guide rods); U.S. Pat. No. 4,878,662 to Chern (discloses a selector rod arrangement for clamping the selected weights together into a collective mass); and U.S. Pat. No. 4,809,973 to Johns (discloses telescoping safety shields which allow insertion of a selector pin but otherwise enclose the weight stack).

Additional weight stack patents include U.S. Pat. No. 5,000,446 to Sarno (discloses discrete selector pin configurations intended for use on discrete machines); U.S. Pat. No. 4,546,971 to Raasoch (discloses levers operable to remotely select a desired number of weights in a stack); U.S. Pat. No. 5,037,089 to Spagnuolo et al. (discloses a controller operable to automatically adjust weight stack resistance); U.S. Pat. No. 4,411,424 to Barnett (discloses a dual-pronged pin which engages opposite sides of a selector rod); U.S. Pat. No. 1,053,109 to Reach (discloses a stack of weight plates, each having a slide which moves into and out of engagement with the weight plate or top plate above it); and U.S. Pat. No. 5,306,221 to Itaru (discloses a stack of weight plates, each having a lever which pivots into and out of engagement with a selector rod.

Still more weight stack improvements and/or features are disclosed in U.S. Pat. No. 772,906 to Reach (discloses weight plates which are interconnected by lever driven bolts); U.S. Pat. No. 848,272 to Thornley (discloses weight plates which are interconnected by rotating levers); U.S. Pat. No. 3,647,209 (discloses a selector rod which moves downward to a desired weight in a stack and then rotates into engagement with the desired weight); Soviet Union Pat. No. 1,258,447 (discloses a rotating cam which pushes spring-loaded plungers into engagement with respective weights in a stack); and Soviet Union Pat. No. 1,389,789 (discloses both a selector rod which moves downward to a desired weight in a stack and then rotates into engagement with the desired weight, and a rotating cam which pushes spring-loaded plungers into engagement with respective weights in a stack).

With respect to free weights, in general, weight plates are typically mounted on opposite sides of a bar. In relatively advanced systems, the bar is stored in proximity to the weight plates, and a selection mechanism is provided to connect a desired amount of weight to the bar. Some examples of patented barbell/dumbbell improvements and/or features are disclosed in U.S. Pat. No. 4,529,198 to Hettick, Jr. (discloses a barbell assembly having opposite side weights which are maintained in alignment on respective storage members and selectively connected to a handle by means of axially movable springs); U.S. Pat. No. 4,822,034 to Shields (discloses both barbell and dumbbell assemblies having opposite side weights which are maintained in alignment on a shelf and selectively connected to a handle by means of latches on the weights); U.S. Pat. No. 4,284,463 to Shields (discloses a dumbbell assembly having opposite side weights which are maintained in alignment on a base and selectively connected to a handle by means of cam driven pins on the weights); U.S. Pat. No. 5,637,064 to Olson et al. (discloses a dumbbell assembly having a plurality of interconnected opposite side weights which are stored in nested relationship to one another and selectively connected to a handle by means of a U-shaped pin); U.S. Pat. No. 5,769,762 to Towley, III et al. (discloses a dumbbell assembly having a plurality of interconnected opposite side weights which are stored in nested relationship to one another and selectively connected to a handle by various means); and U.S. Pat. No. 5,839,997 to Roth et al. (discloses a dumbbell assembly having opposite side weights which are maintained in alignment on a base and selectively connected to a handle by means of eccentric cams on a rotating selector rod.

Despite these advances and others in the field of weight selection, room for improvement and continued innovation remains.

SUMMARY OF THE INVENTION

An aspect of the present invention is to rotate a selector rod into engagement with one or more aligned weight plates to provide adjustable resistance to exercise movement. The selector rod has a dedicated weight support for each of the weight plates. On a first embodiment, the selector rod extends vertically and is movable axially into and out of a vertical stack of weights. On a second embodiment, the selector rod extends horizontally and is movable radially into and out of a horizontal stack of weights. Additional features and advantages of the present invention will become apparent to those skilled in the art from the more detailed description that follows.

BRIEF DESCRIPTION OF THE FIGURES OF THE DRAWING

With reference to the Figures of the Drawing, wherein like numerals represent like parts and assemblies throughout the several views.

DETAILED DESCRIPTION OF THE PREFERRED EMBODIMENT

The present invention provides methods and apparatus which facilitate the provision of selectively adjustable weight resistance to exercise motion. Generally speaking, the present invention allows a person to adjust weight resistance by rotating one or more selector rods relative to a plurality of aligned weights in order to select a desired amount of weight.

Figure 1:
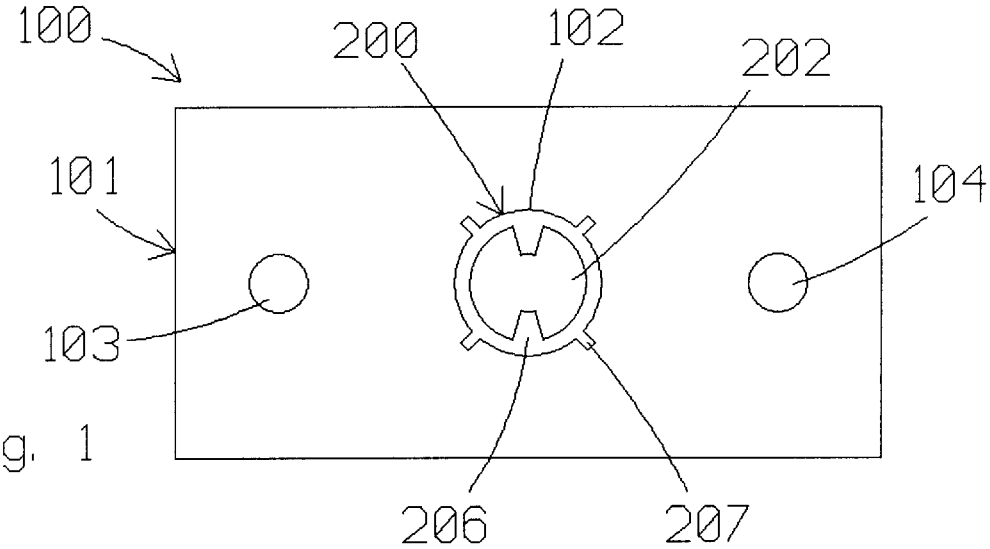
FIG. 1 is a top view of a weight stack plate and insert constructed according to the principles of the present invention.

A first embodiment of the present invention is described with reference to a weight stack machine and components thereof shown in FIGS. 1–18. A weight stack plate constructed according to the principles of the present invention is designated as 100 in FIG. 1. The weight stack plate 100 includes a weight 101 and an attachment or insert 200.

Figure 2:
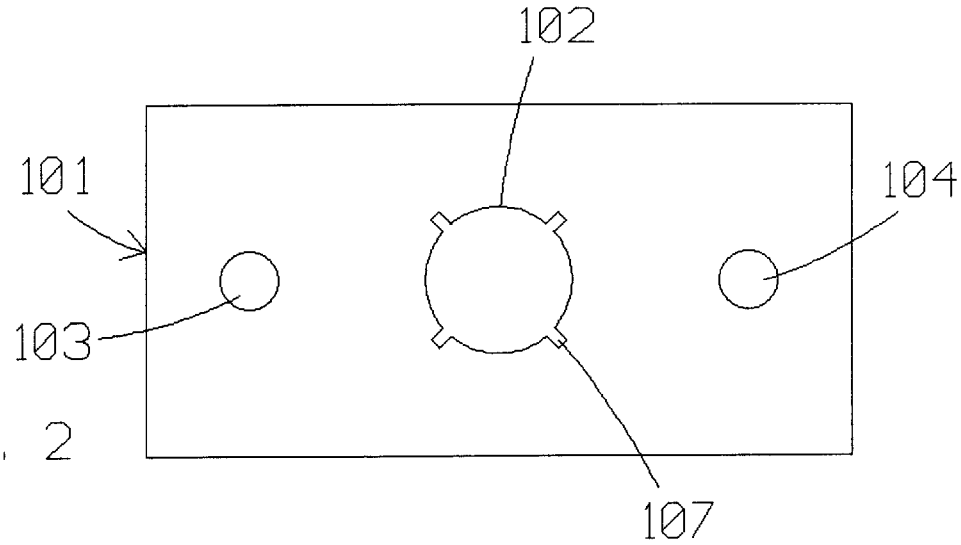
FIG. 2 is a top view of the weight stack plate of FIG. 1, the insert having been removed.
Figure 3:
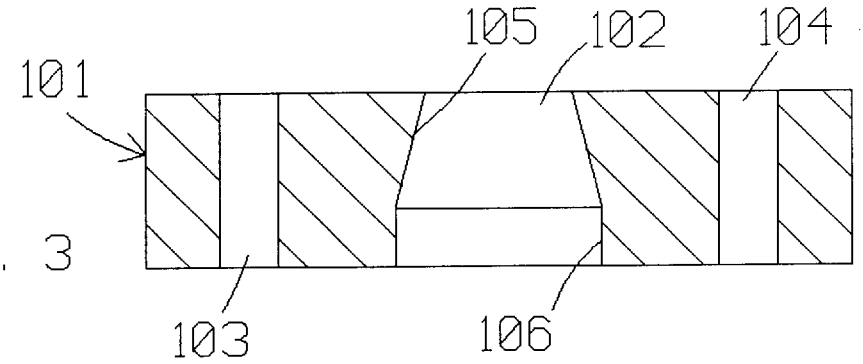
FIG. 3 is a sectioned side view of the weight stack plate of FIG. 2.

The weight 101 is shown by itself in FIGS. 2–3. The weight 101 is generally rectangular in shape and is made from a relatively heavy and durable material, such as steel. Circular holes 103 and 104 are formed through the weight 101, proximate opposite ends thereof, to receive guide rods (designated as 713 and 714 in FIG. 17) in a manner known in the art. Those skilled in the art will recognize that guide rods are commonplace on most weight stacks, but also, that the present invention is not limited to such an arrangement. For example, one viable alternative is disclosed in U.S. Pat. No. 5,374,229 to Sencil, which is incorporated herein by reference to same.

Figure 13:
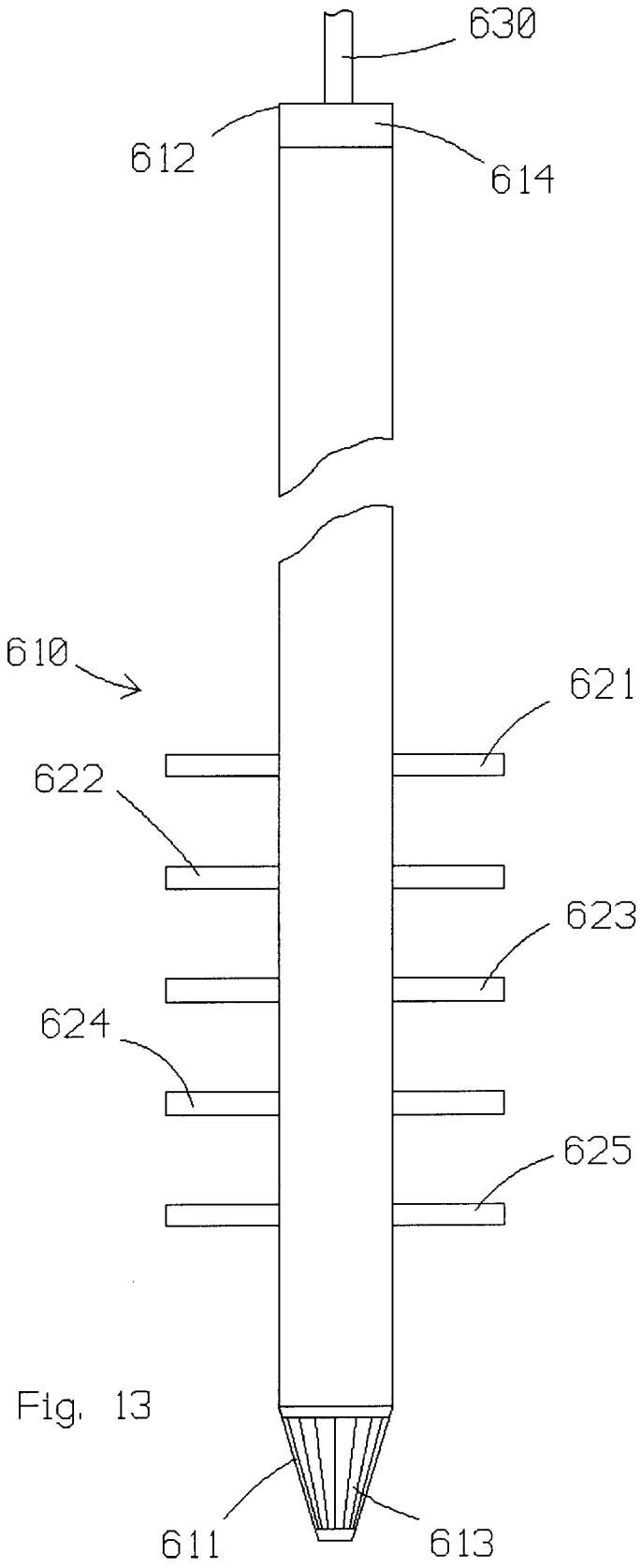
FIG. 13 is a fragmented front view of a selector rod constructed according to the principles of the present invention and suitable for use together with the weight stack of FIG. 12.

A relatively larger opening 102 is formed through the center of the weight 101 to receive the insert 200 and accommodate a selector rod (designated as 610 in FIG. 13). The central opening 102 is generally circular but includes radially extending slots 107 which are circumferentially spaced about the opening 102. As shown in FIG. 3, the opening 102 is formed in part by a conical sidewall 105 which diverges away from the top of the weight 101, and in part by a cylindrical sidewall 106 which meets the conical sidewall 105 within the weight 101 and continues through to the bottom of the weight 101.

Figure 4:
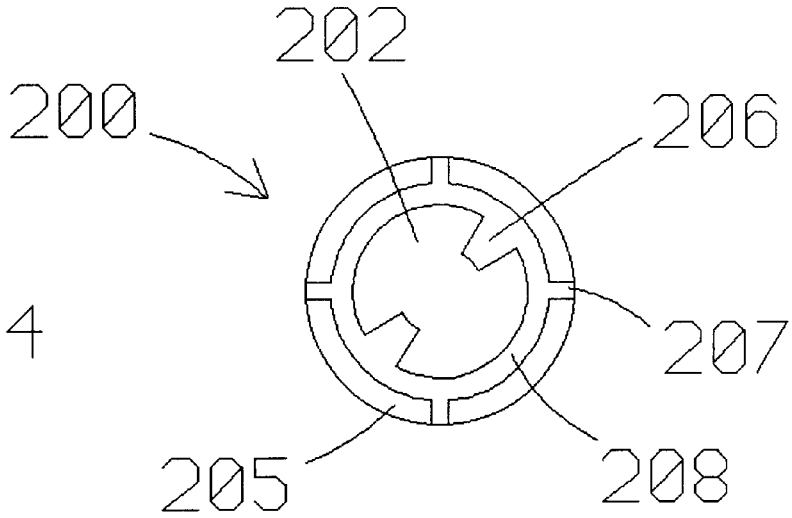
FIG. 4 is a top view of the insert of FIG. 1.
Figure 5:
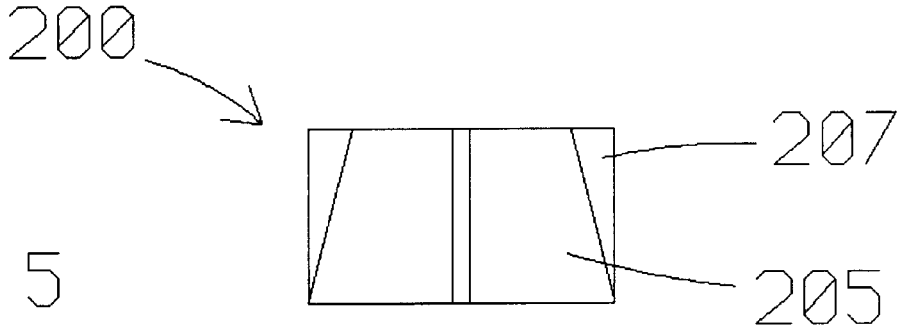
FIG. 5 is a side view of the insert of FIG. 1.
Figure 6:
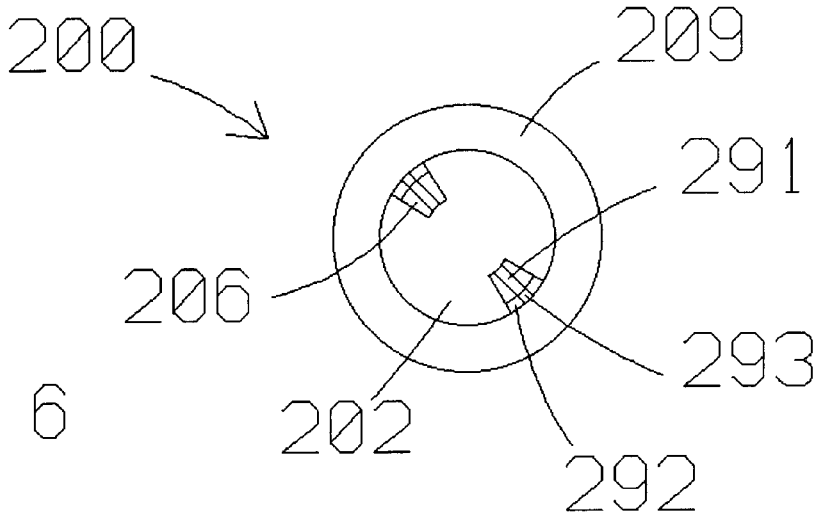
FIG. 6 is a bottom view of the insert of FIG. 1.

The insert 200 is shown by itself in FIGS. 4–6. The insert 200 is generally conical in shape and is made from a relatively durable and conveniently molded material, such as plastic. The insert 205 has a conical sidewall 205 which is sized and configured to concentrically nest within the conical sidewall 105 of the weight 101. The sidewall 205 extends between a top surface 208 and a bottom surface 209. The sidewall 205 bounds a central opening 202 which extends through the insert 200. Diametrically opposed tabs 206 extend radially inward from the sidewall 205 and cooperate with the sidewall 205 to define a keyway (for reasons discussed below).

Fins 207 extend radially outward from the sidewall 205 and are sized and configured to nest within the slots 107 in the weight 101. The fins 207 and the slots 107 cooperate to align the insert 200 relative to the weight 101 and to prevent rotation of the former relative to the latter. Those skilled in the art will recognize that the orientation of each insert is significant, but also, that the present invention is not limited to this particular manner of construction. For example, some additional insert attachment methods are disclosed in U.S. Pat. No. 4,601,466 to Lais, which is incorporated herein by reference to same.

Figure 7:
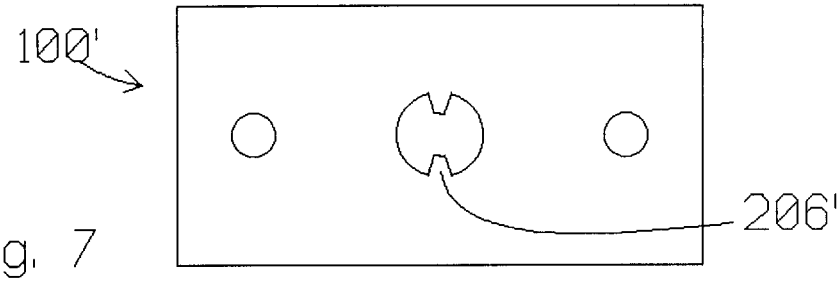
FIG. 7 is a top view of a weight stack weight identical in size and configuration to the weight stack plate and insert of FIG. 1.

A set of weight stack plates is shown in FIGS. 7–11. The weight stack plate 100' in FIG. 7 is similar to that shown in FIG. 1, except that the keyway is formed in the plate itself, rather than by securing an insert to the plate 100'. The inclusion of FIG. 7 is intended to emphasize that the present invention is not limited to either a specific combination of parts or a particular method of construction.

Figure 8:
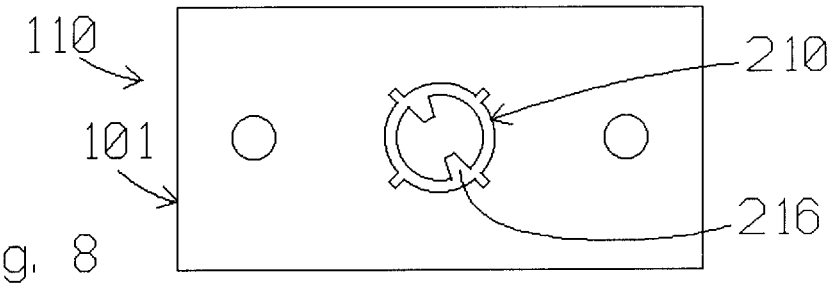
FIG. 8 is a top view of the weight stack plate of FIG. 2 together with a second discrete insert.
Figure 9:
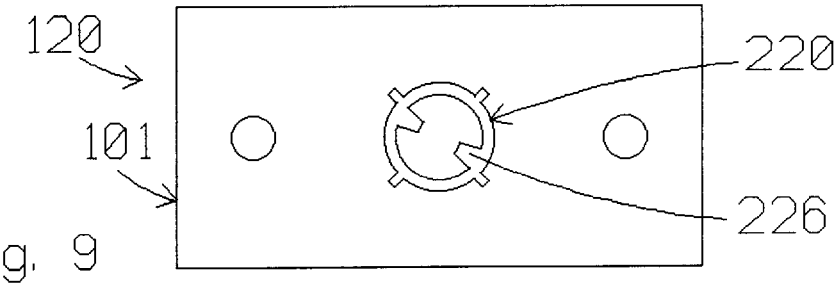
FIG. 9 is a top view of the weight stack plate of FIG. 2 together with a third discrete insert.
Figure 10:
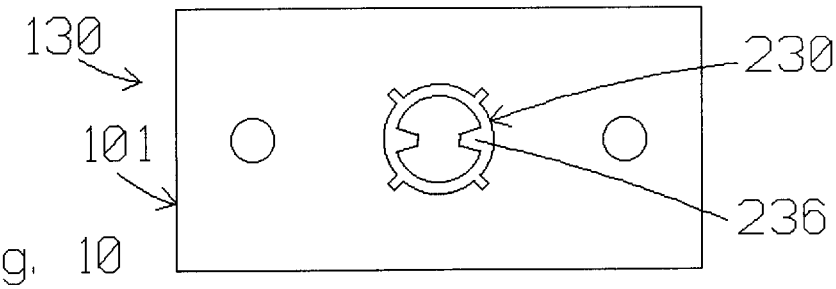
FIG. 10 is a top view of the weight stack plate of FIG. 2 together with the insert of FIG. 1, but oriented differently.
Figure 11:
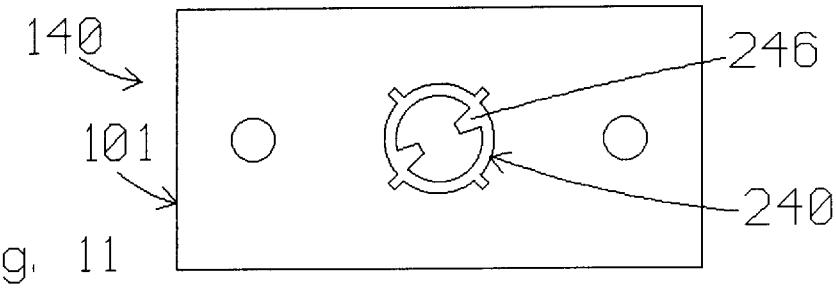
FIG. 11 is a top view of the weight stack plate of FIG. 2 together with the insert of FIG. 8, but oriented differently.
Figure 12:
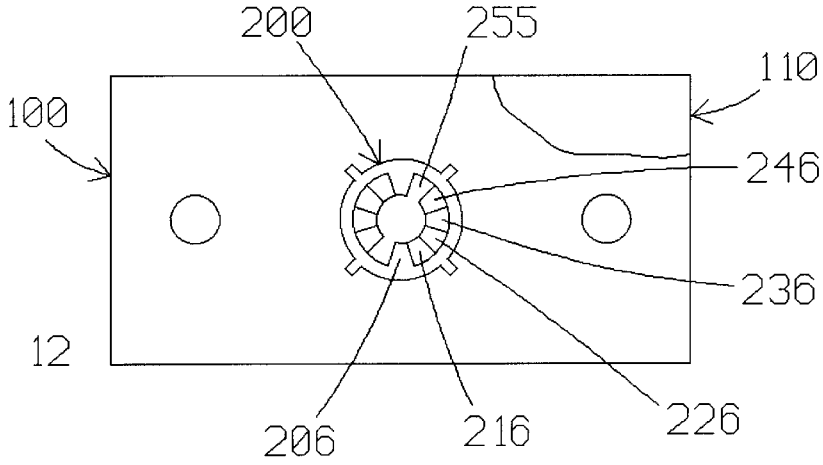
FIG. 12 is a top view of a weight stack comprising the weight stack plates and inserts of FIGS. 1 and 8–11, the plates having been stacked one on top of the other.
Figure 14:
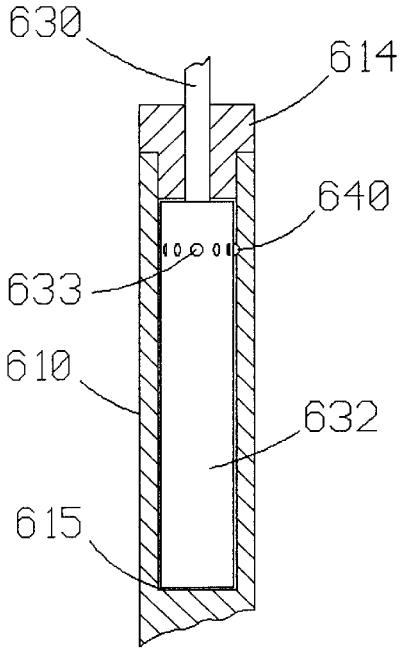
FIG. 14 is a sectioned front view of an upper portion of the selector rod of FIG. 13.

A second weight stack plate 110 is shown in FIG. 8. The weight stack plate 110 includes an identical weight 101 and a distinct insert 210. In particular, the insert 210 has structural features similar to those of the insert 200, except for the relative orientations of the tabs 216 and the fins 207 (and the orientation of the resulting keyway). In other words, the tabs 216 and the tabs 206 (or 206') occupy discrete sectors when the plate 110 is aligned with and stacked beneath the plate 100 (or 100'). The same may be said for each of the weight stack plates 120, 130, and 140 and corresponding inserts 220, 230, and 240 shown in FIGS. 9, 10, and 11, respectively. Thus, when the weight stack plates 100, 110, 120, 130, and 140 are stacked one above the other, as shown in FIG. 12, the tabs 206, 216, 226, 236, and 246 on the weight plates are disposed at discrete orientations (and within discrete sectors) relative to one another, and they leave diametrically opposed openings 255 unobstructed along the height of the stack.

A selector rod 610 and portions thereof are shown in FIGS. 13–16. The rod 610 extends between a first, lower end 611 and a second, upper end 612. Gear teeth 613 are disposed on the lower end 611 to provide a means for rotating the rod 610. A cap 614 is threaded onto the upper end 612 of the rod 610 and effectively seals off a compartment 615. A shaft 632 is disposed within the compartment 615 and connected to an end of a flexible cable or connector 630. As is known in the art, an opposite end of the cable 630 is connected to a force receiving member which may be acted upon subject to resistance from the weight of the selector rod 610 and any weight stack plates engaged thereby. Those skilled in the art will recognize that the present invention is not limited to any particular type or number of force receiving members or any particular method of connecting the force receiving member(s) to the selector rod or top plate in the weight stack. A few of the numerous possibilities are disclosed in U.S. Pat. No. 3,912,261 to Lambert, Sr.; U.S. Pat. No. 5,263,915 to Habing; U.S. Pat. No. 4,900,018 to Ish III, et al.; and U.S. Pat. No. 4,878,663 to Luquette, which patents are incorporated herein by reference to same.

Depressions 633 are formed in the shaft 632 proximate the upper end thereof to selectively receive a ball detent 640 mounted on the sidewall of the compartment 615. As a result of this arrangement, the rod 610 is rotatable relative to the shaft 632 and the cable 630, and the ball detent 640 and holes 633 cooperate to bias the rod 610 toward discrete orientations (or sectors) relative to the shaft 632 and the cable 630. These discrete orientations of the holes 633 coincide with the orientations of the tabs 206, 216, 226, 236, and 246 on the respective weight stack plates 100, 110, 120, 130, and 140.

Figure 15:
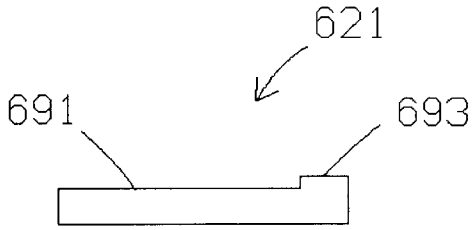
FIG. 15 is an enlarged front view of a catch on the selector rod of FIG. 13.

Selector pins 621–625 extend radially outward from opposite sides of the rod 610. Each of the pins 621–625 is disposed immediately beneath, and within the cylindrical wall 106 of, a respective weight stack plate 100, 110, 120, 130, or 140. As shown in FIG. 15, each of the pins 621–625 includes a main beam 691 with an upwardly extending nub 693 on a distal end thereof.

Figure 16:
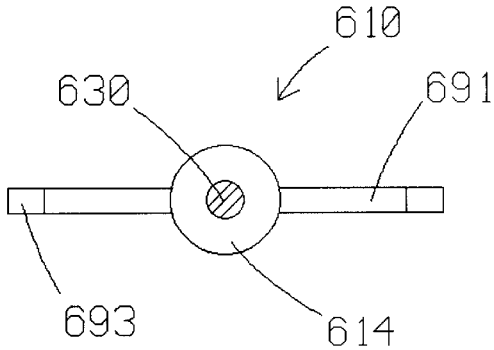
FIG. 16 is a top view of the selector rod of FIG. 13.

Looking at the top view of the selector rod 610 shown in FIG. 16, and the top view of the stacked plates shown in FIG. 12, one can see how the pins 621–625 may be rotated into alignment with any one of the pairs of weight plate tabs 206, 216, 226, 236, or 246 or the unobstructed openings 255. If the pins 621–625 are aligned with the openings 255, then none of the weight stack plates 100, 110, 120, 130, or 140 will be carried upward by the selector rod 610, and exercise (pulling on the cable 630) may be performed subject only to the weight of the selector rod 610.

Those skilled in the art will recognize that a top plate is typically rigidly secured to the selector rod to keep the selector rod aligned with the stack under all circumstances of operation (including the situation where no selector pin is inserted). Such a top plate may be added to this embodiment of the present invention to move up and down with the selector rod but nonetheless allow rotation of the selector rod relative to the stack. With the addition of a top plate, the minimal resistance setting will include the weight of such a top plate, as well.

If the pins 621–625 are aligned with the tabs 206 on the first weight stack plate 100, then exercise may be performed subject to the weight of the selector rod 610 and the uppermost weight stack plate 100. In this instance, the main beams 691 of the pins 621 engage first recesses 291 in the underside of the tabs 206, and the nubs 693 move through grooves 292 and into second recesses 293 (see FIG. 6). The recesses 291 cooperate with the main beams 691 to bias the weight stack plate 100 against rotation relative to the selector rod 610 during exercise movement. Similarly, the recesses 293 cooperate with the nubs to discourage both rotation and radial movement of the weight stack plate 100 relative to the selector rod 610 during exercise movement.

Figure 17:
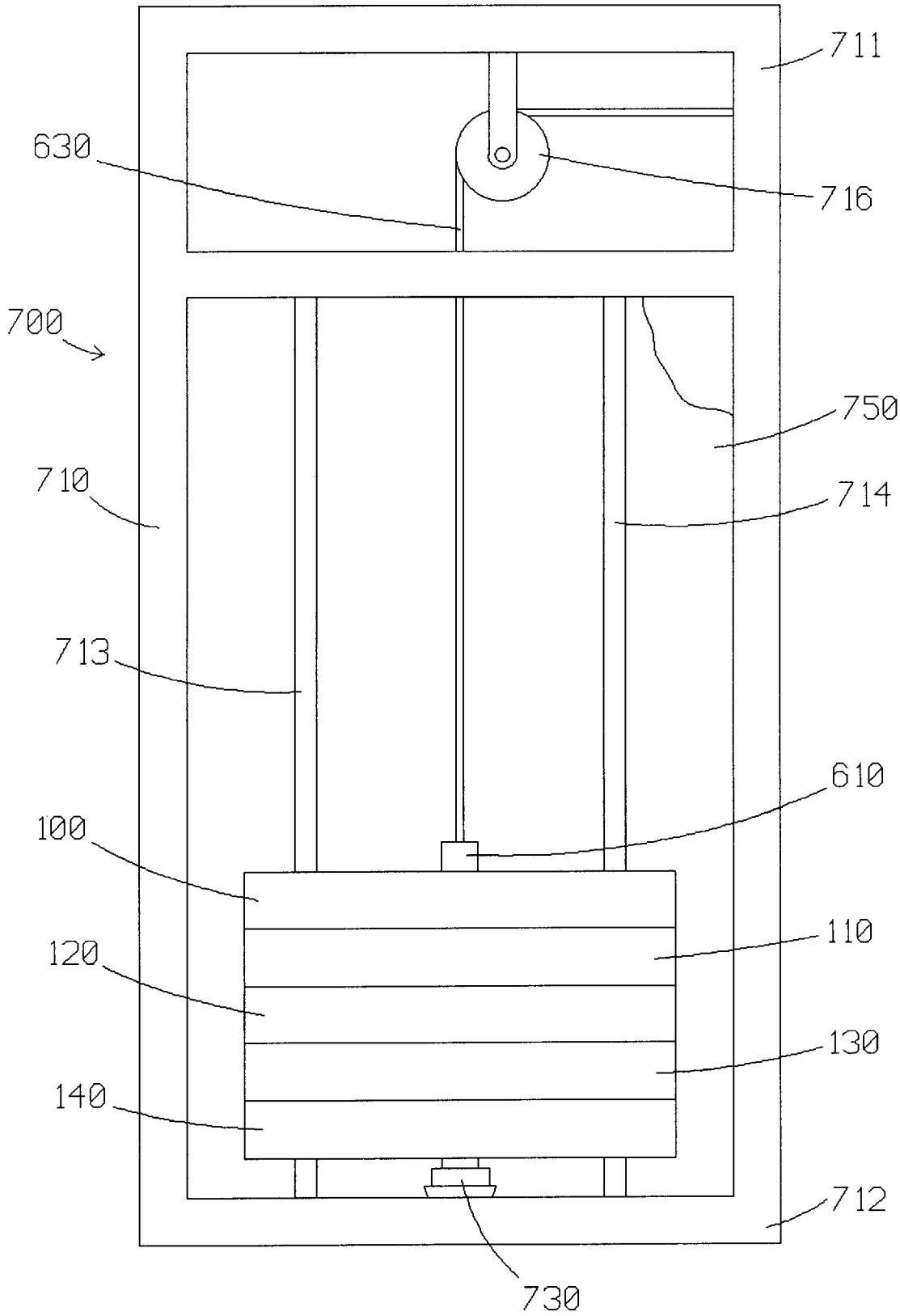
FIG. 17 is a front view of an exercise apparatus constructed according to the present invention and including the weight stack of FIG. 12 and the selector rod of FIG. 13.

The weight stack plates 100, 110, 120, 130, and 140 and the selector rod 610 are shown on an exercise apparatus 700 in FIG. 17. The exercise apparatus 700 includes a frame 710 having an upper end 711 and a lower end 712, with guide members or rods 713 and 714 extending vertically therebetween. The guide rods 713 and 714 extend through the holes 103 and 104, respectively, in the weights 101 and help to maintain alignment of the weight stack plates 100, 110, 120, 130, and 140 relative to one another. The cable 630 extends upward from the connector rod 610 to a pulley 716 which routes the cable 630 toward a force receiving member of any type known in the art. A unitary protective shield 750 may be secured across the entire side of the frame 710 and function as a partition between the stack of weights and any objects and/or people in the vicinity of the apparatus 700. An opaque shield may used to the extent that it is considered advantageous to hide the amount of weight being lifted.

Figure 18:
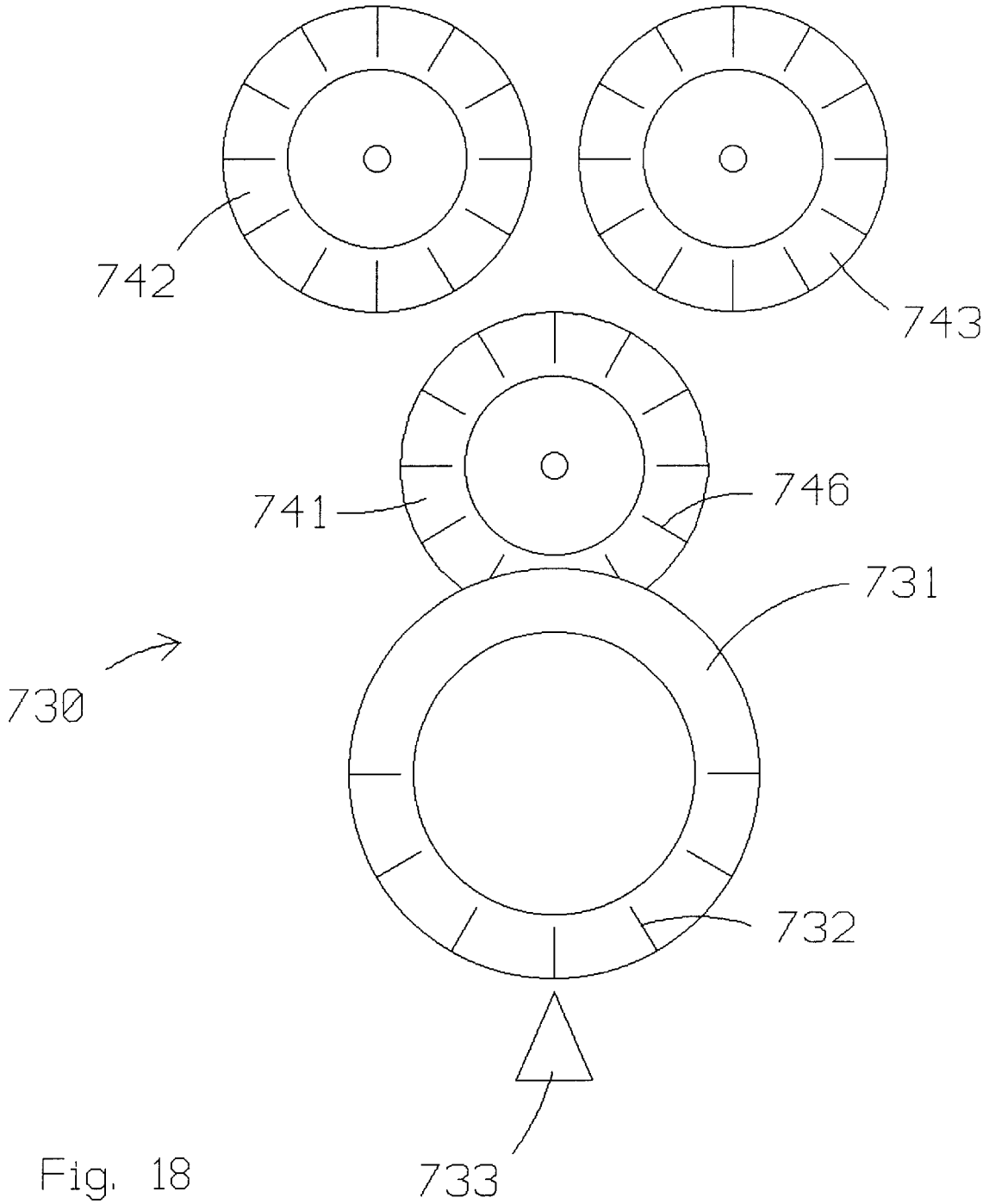
FIG. 18 is a top view of an adjustment assembly on the exercise apparatus of FIG. 17.
Figure 19:
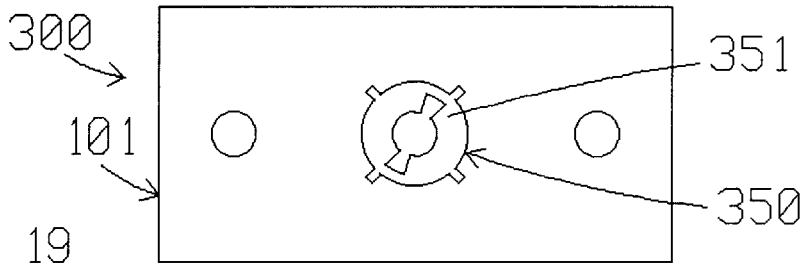
FIG. 19 is a top view of the weight of FIG. 2 together with a second type of insert constructed according to the present invention.
Figure 20:
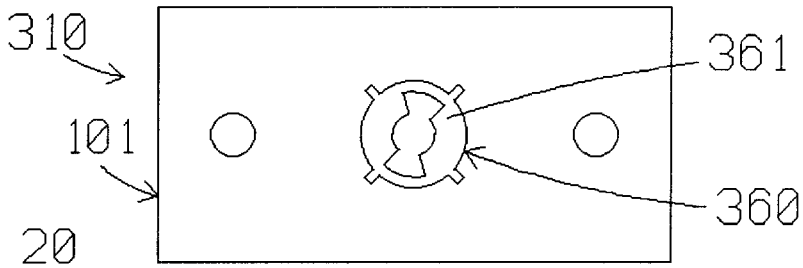
FIG. 20 is a top view of the weight of FIG. 2 together with a second discrete insert of the second type.
Figure 21:
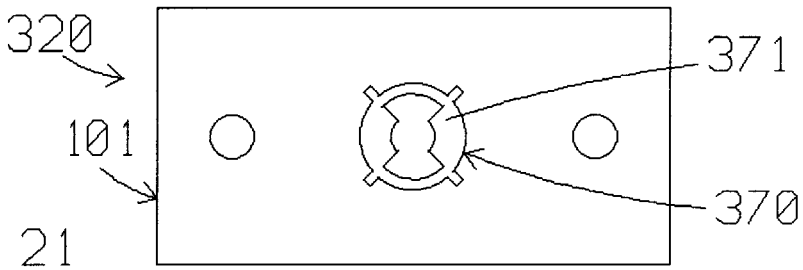
FIG. 21 is a top view of the weight of FIG. 2 together with a third discrete insert of the second type.
Figure 22:
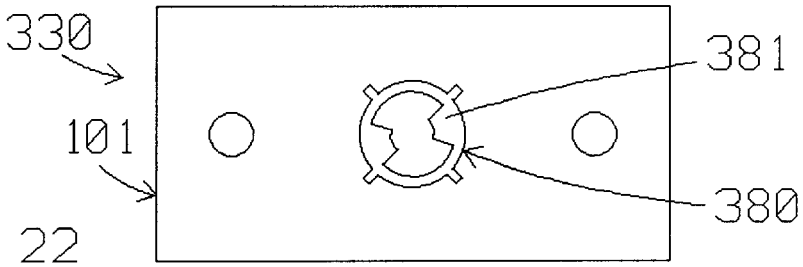
FIG. 22 is a top view of the weight of FIG. 2 together with a fourth discrete insert of the second type.
Figure 23:
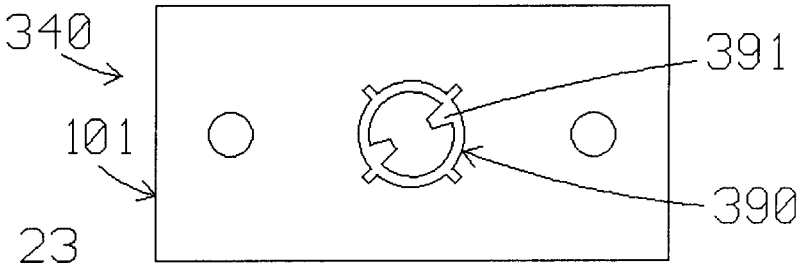
FIG. 23 is a top view of the weight of FIG. 2 together with an insert similar to the insert of FIG. 11.

The lower end 611 of the rod 610 engages a gear assembly 730 in the absence of a threshold amount of tension in the cable 630. The gear assembly 730 cooperates with the gear teeth 613 on the rod 610 to provide a means for rotating the rod 610 relative to the weight stack plates 100, 110, 120, 130, and 140. As shown in FIG. 18, three idler gears 741–743 are arranged in an equilateral triangle formation suitable for receiving the lower end 611 of the rod 600 in the center thereof. Each of the idler gears 741–743 is provided with gear teeth 746 which mate with the gear teeth 613 on the rod 610. Positioned adjacent the idler gear 741 is a knob 731 which has teeth that mate with the gear teeth 746 on the idler gear 741. As a result of this arrangement, rotation of the knob 731 causes rotation of the rod 610. Markings 732 on the knob 731 cooperate with a pointer 733 on the frame 710 to indicate the orientation of the pins 621–625 relative to the tabs 206, 216, 226, 236, and 246, and thereby indicate the amount of weight selected.

Those skilled in the art will recognize that the foregoing description is merely illustrative, and that the present invention is not limited to the specifics thereof. For example, another, discrete type of weight stack plate is shown in FIGS. 19–24. These weight stack plates 300, 310, 320, 330, and 340 include the same weight 101 as the previous embodiment, but a different set of inserts. The alternative inserts 350, 360, 370, 380, and 390 are provided with respective tabs 351, 361, 371, 381, and 391, which are engaged by respective pins 621–625 whenever a relatively lower weight stack plate is engaged. For example, when the selector rod 610 is rotated to select the third highest weight stack plate 320, the pins 621 underlie the tabs 351, the pins 622 underlie the tabs 361, and the pins 623 underlie the tabs 371, while the pins 624 remain clear of the tabs 381, and the pins 625 remain clear of the tabs 391. An advantage of this particular arrangement is that the load of each weight stack plate is supported by a respective set of pins.

Figure 24:
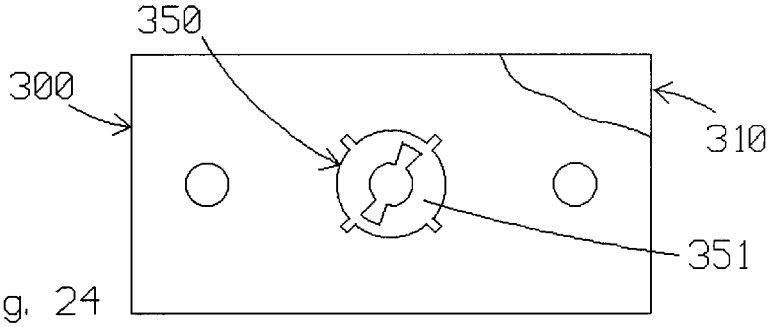
FIG. 24 is a top view of a weight stack comprising the weights and inserts of FIGS. 19–23, the weights having been stacked one on top of the other.
Figure 25:
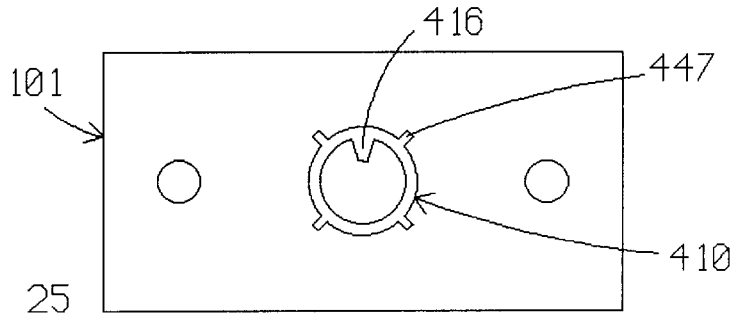
FIG. 25 is a top view of the weight of FIG. 2 together with a third type of insert constructed according to the present invention.
Figure 26:
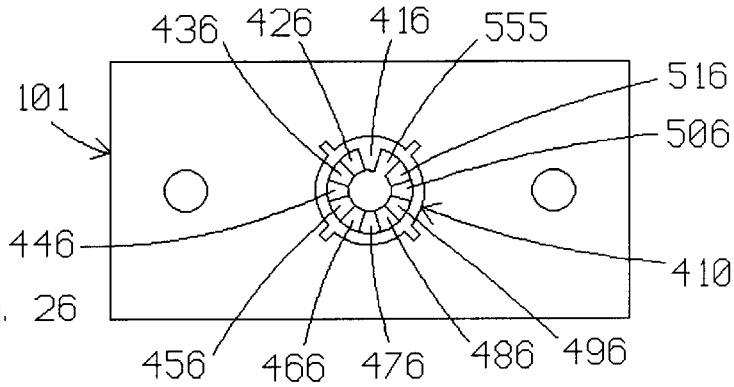
FIG. 26 is a top view of a weight stack including the weight and insert of FIG. 25 and ten additional weights and inserts stacked beneath the weight and insert of FIG. 25.

Yet another, discrete type of weight stack plate is shown in FIGS. 25–26. These weight stack plates likewise include the same weight 101 as the previous embodiments and another different set of inserts. The alternative inserts, one of which is designated as 410, are provided with respective tabs 416, 426, 436, 446, 456, 466, 476, 486, 496, 506, and 516, (as well as fins 447, for example) and are intended for use with a selector rod having only a single, radially extending selector pin at each discrete elevation. This embodiment gains the advantage of accommodating additional weight stack plates, but at the expense of engaging each plate in only a single sector (as opposed to diametrically opposed sectors). The relatively higher inserts in this embodiment may be modified to function like those shown in FIGS. 19–24, so that the load from multiple weight stack plates is distributed among respective pins.

Figure 27:
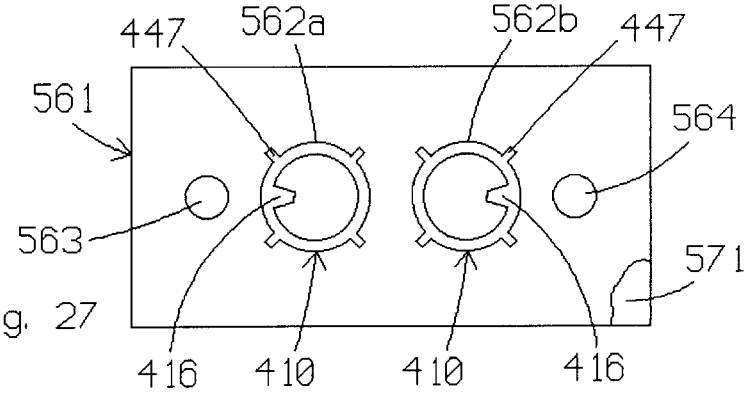
FIG. 27 is a top view of a weight of a different type together with two inserts of the third type.

Still another, discrete type of weight stack plate is shown in FIG. 27. These weight stack plates, two of which are designated as 561 and 571, require a different type of weight, but inserts similar to those shown in FIG. 25. The weight itself has two relatively larger openings 562*a* and 562*b*, in addition to two guide rod holes 563 and 564. Each of the larger openings 562*a* and 562*b* is configured similar to the opening 102 shown in FIGS. 2–3. In this embodiment, all of the inserts 410 are identical to that shown in FIG. 25, and all are inserted into their respective weights at the same orientation shown in FIG. 27. As a result, all of the tabs 416 within a respective column of inserts are aligned with one another (or occupy a single sector).

Figure 28:
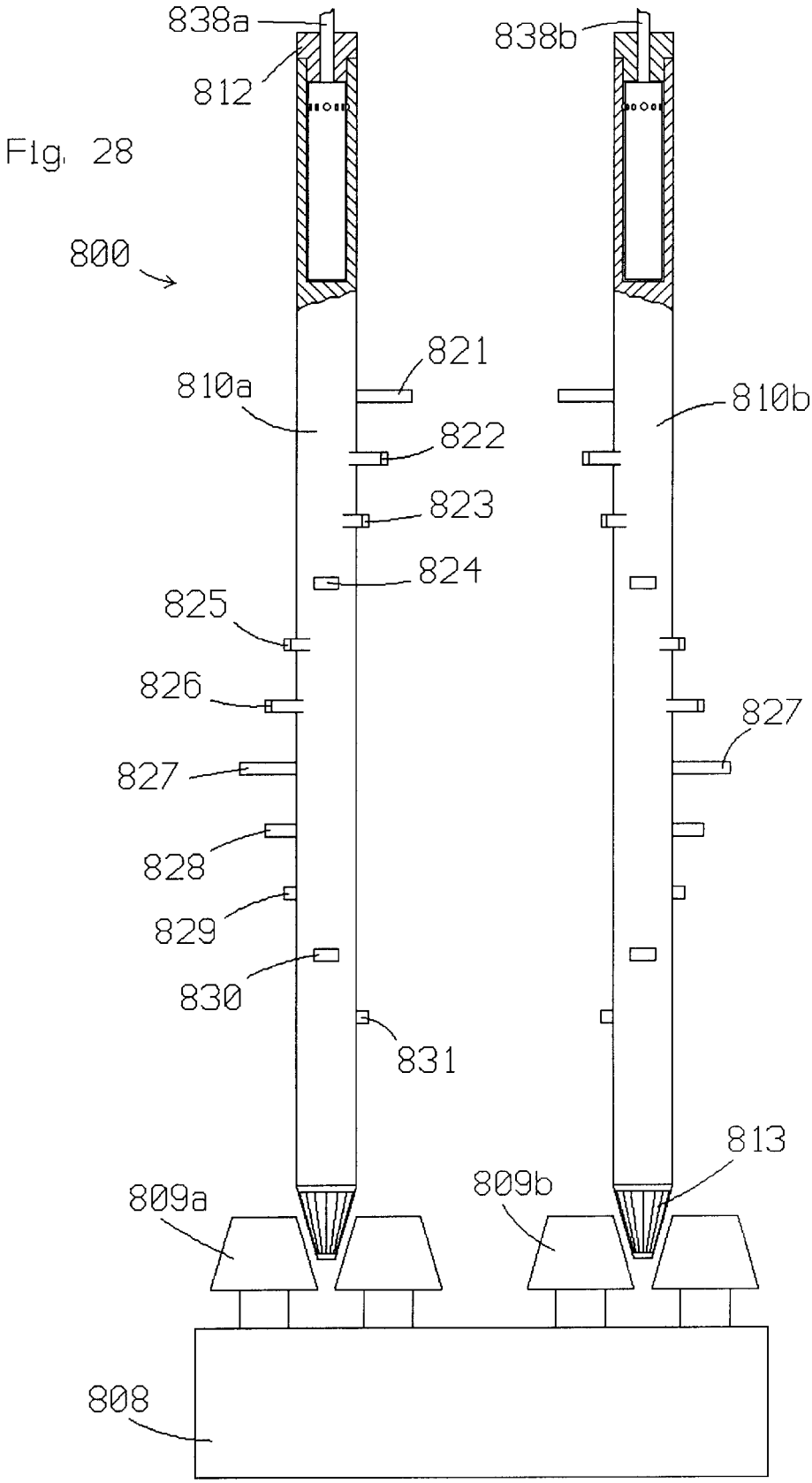
FIG. 28 is a front view of a pair of selector rods constructed according to the principles of the present invention and suitable for use together with the weight of FIG. 27.

The selector assembly for this embodiment is designated as 800 in FIG. 28. The selector assembly 800 includes two selector rods 810*a* and 810*b* which are rotated in opposite directions by a motorized gear box 808 (in response to signals generated by a controller, for example). Those skilled in the art will recognize that a variety of methods and apparatus are available for such a purpose. Examples of automatic and/or remotely controlled weight selection are disclosed in U.S. Pat. No. 5,037,089 to Spagnuolo et al. and U.S. Pat. No. 4,546,971 to Raasoch, which are incorporated herein by reference to same. Each selector rod 810*a* and 810*b* has threads 813 on its lower end which interengage with respective gears 809*a* and 809*b* on the motorized gear box 808. Each selector rod 810*a* and 810*b* has an upper end 812 similar to that on the selector rod 610 shown in FIGS. 13–14. The cables 838*a* and 838*b* extend upward and are connected to respective pulleys which, in turn, are keyed to a common shaft. An additional cable is connected to a separate pulley on the shaft and then routed to an exercise member.

Each selector rod 810*a* and 810*b* also has pins 821–831 extending radially outward into discrete sectors about a respective rod. Rotation of the rods 810*a* and 810*b* brings opposing pairs of pins 821–831 into alignment with the tabs 416 on successively lower (or higher) weight stack plates. This embodiment may be seen to be advantageous because the selected weight stack is supported at two discrete locations, despite the accommodation of a greater number of weight stack plates.

Another embodiment of the present invention (not shown fully assembled) combines the foregoing cable and pulley arrangement with each of two discrete weight stacks configured to require only a single selector rod. In other words, a first cable extends upward from a first selector rod to a first pulley, and a second cable extends upward from a second selector rod to a second pulley. The first selector rod inserts through seven weight stack plates weighing five pounds and disposed in a first stack, and the second selector rod inserts through seven weight stack plates weighing forty pounds and disposed in a second stack. In this example, the amount of resistance can be varied in five pound increments from five pounds to three hundred and fifteen pounds. Another variation is to rotatably mount the two selector rods on a single carriage, which in turn, is suspended from a single cable that extends all the way to the exercise member.

Figure 29:
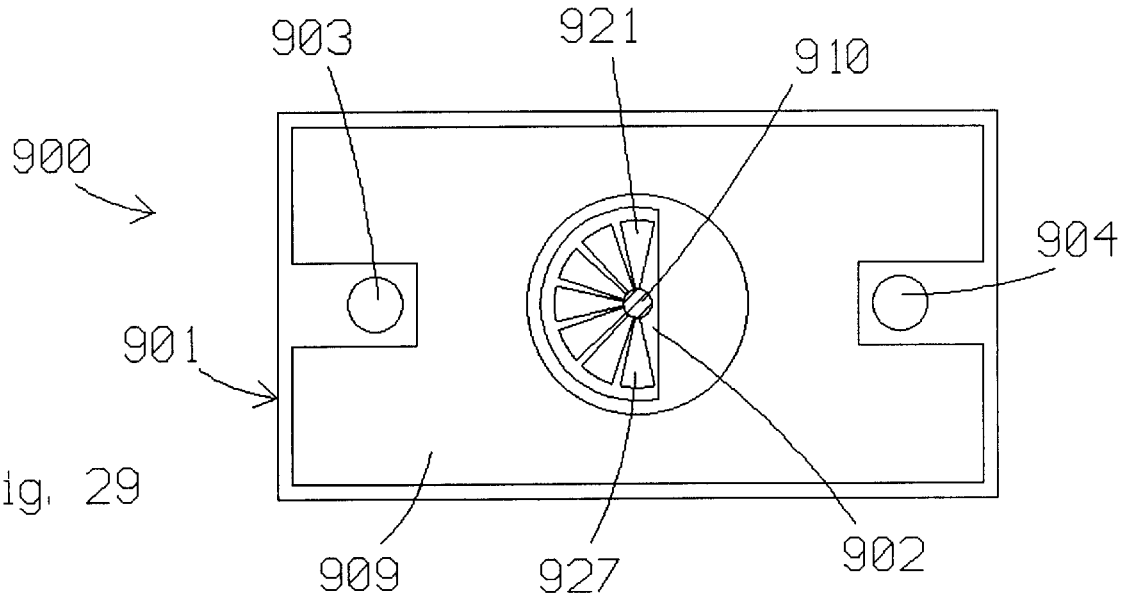
FIG. 29 is a partially sectioned top view of a weight stack comprising yet another type of weight, with a selector rod in a first orientation relative to weights within the stack.
Figure 30:
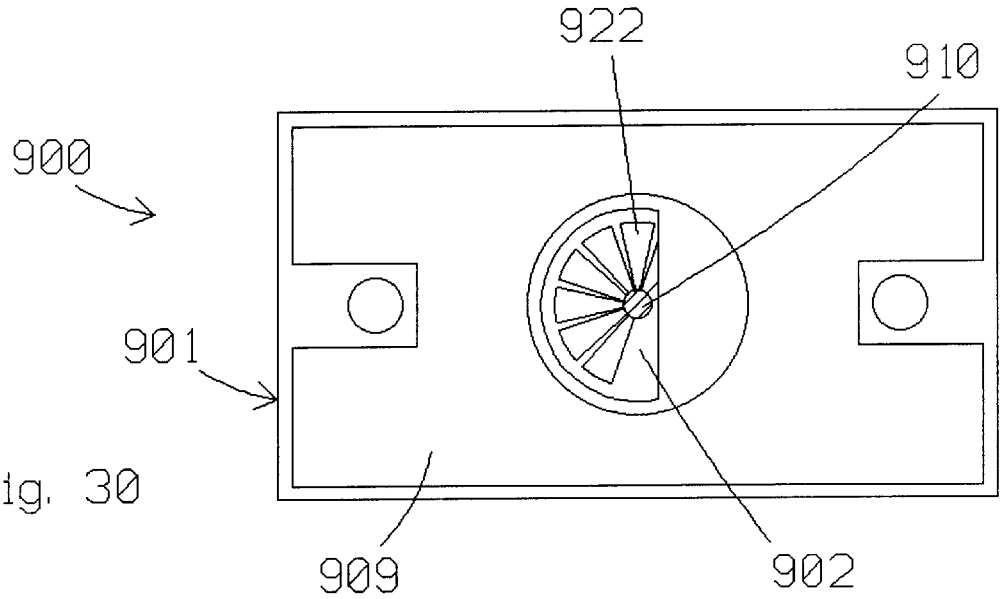
FIG. 30 is a partially sectioned top view of the weight stack of FIG. 29, with the selector rod occupying a second orientation relative to the weights within the stack.
Figure 31:
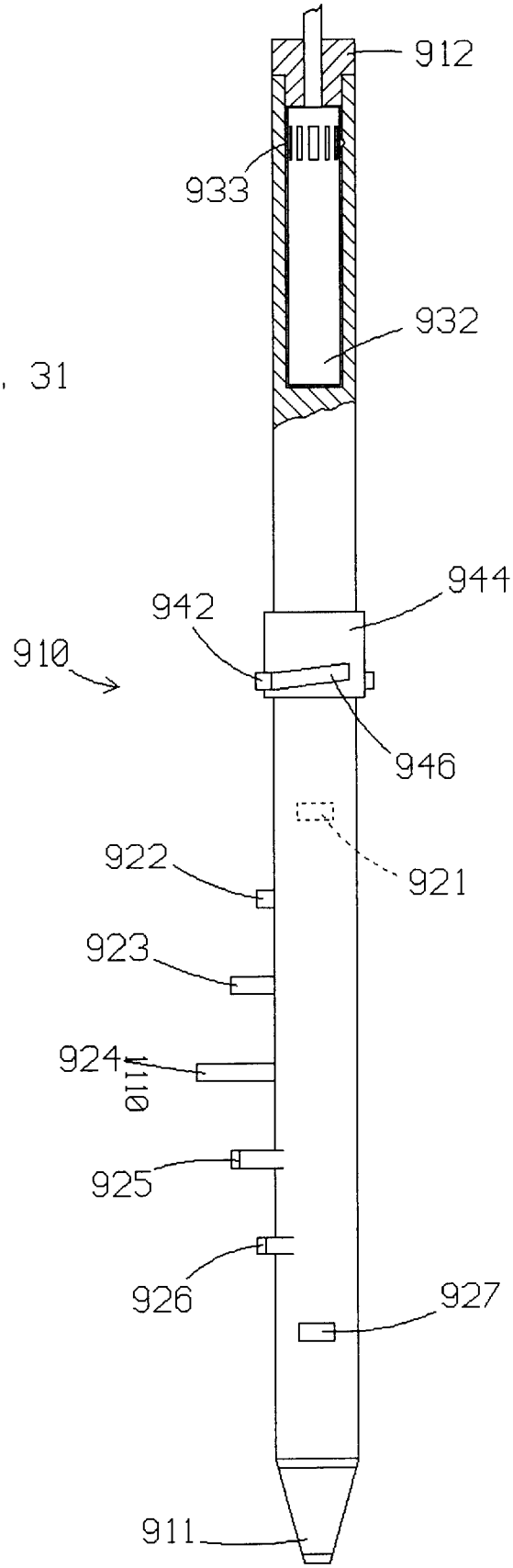
FIG. 31 is a front view of the selector rod of FIG. 29.

Yet another embodiment of the present invention is shown in FIGS. 29–31. A weight stack plate 900 includes a weight 901 without any insert. The weight 901 is generally rectangular and made from a relatively heavy and durable material, such as steel. Circular holes 903 and 904 are formed through the weight 901, proximate opposite ends thereof, to receive guide members or rods in a manner known in the art. A larger opening 902 is formed through the center of the weight 901 to accommodate a selector rod (designated as 910 in FIG. 31). The central opening 902 is generally semi-circular, defining a sector of somewhat more than 180 degrees, and it extends straight down through the weight 901. A generally H-shaped depression 909 is formed in the top of the weight 901 to accommodate a generally H-shaped spacer 999 which is made of rubber (or other suitable shock-absorbing material).

The selector rod 910 extends between a first, lower end 911 and a second, upper end 912. The upper end 912 is similar to that on the selector rod 610, and it accommodates a shaft 932 having slots 933 formed therein, proximate the upper end thereof. The slots 933 similarly cooperate with a ball detent to bias the rod 910 toward discrete orientations, while also allowing for slight axial movement of the rod 910 relative thereto. The lower end 911 is generally pointed but lacks the gear teeth of the selector rod 610. Selector pins 921–927 extend radially outward from the selector rod 910 in discrete sectors disposed about the rod. Each of the pins 921–927 is disposed immediately beneath a respective weight stack plate, like the one designated as 900.

Looking at the top view of the selector rod 910 and weight stack plate 900 shown in FIG. 29, one can see that the rod 910 may occupy an orientation wherein all of the pins 921–927 are free of the weight stack plates, in which case exercise may be performed subject only to the weight of the selector rod 910 (and any top plate). FIG. 30 shows that the rod 910 may be rotated, by hand for example, to an orientation wherein the pin 921 underlies the uppermost weight stack plate. The selector rod 910 may be rotated further to place additional pins 922–927 under successively lower plates.

As shown in FIG. 31, locking pins 942 extend radially outward from the selector rod 910 at diametrically opposed locations. A collar 944 is rotatably mounted on the selector rod 910, with the locking pins 942 extending through respective slots 946 in the collar 944. The lower end of the collar 944 occupies a position adjacent the uppermost weight stack plate, and the slots 946 extend at an angle relative thereto. Once the desired number of weight stack plates has been selected, the collar 944 may be rotated to clamp the selected weights together.

The stability of the selected weights may be enhanced by ridges and/or recesses provided in the underside of the plates to selectively engage the pins 921–927 and discourage rotation of the latter relative to the former except when the collar 944 is loosened. Another option is to provide angled bearing surfaces on the pins 921–927 which will tend to push upward on respective weight stack plates upon rotation into engagement therewith.

Yet another variation of the present invention (not shown) is to eliminate the central opening through each weight stack plate and dispose the selector rod(s) outside the planform of the plates. Pins on the rod(s) may be selectively rotated beneath respective plates to engage same. In other words, those skilled in the art will recognize that the present invention is not limited to selector rods which insert through the plates in a weight stack.

Figure 32:
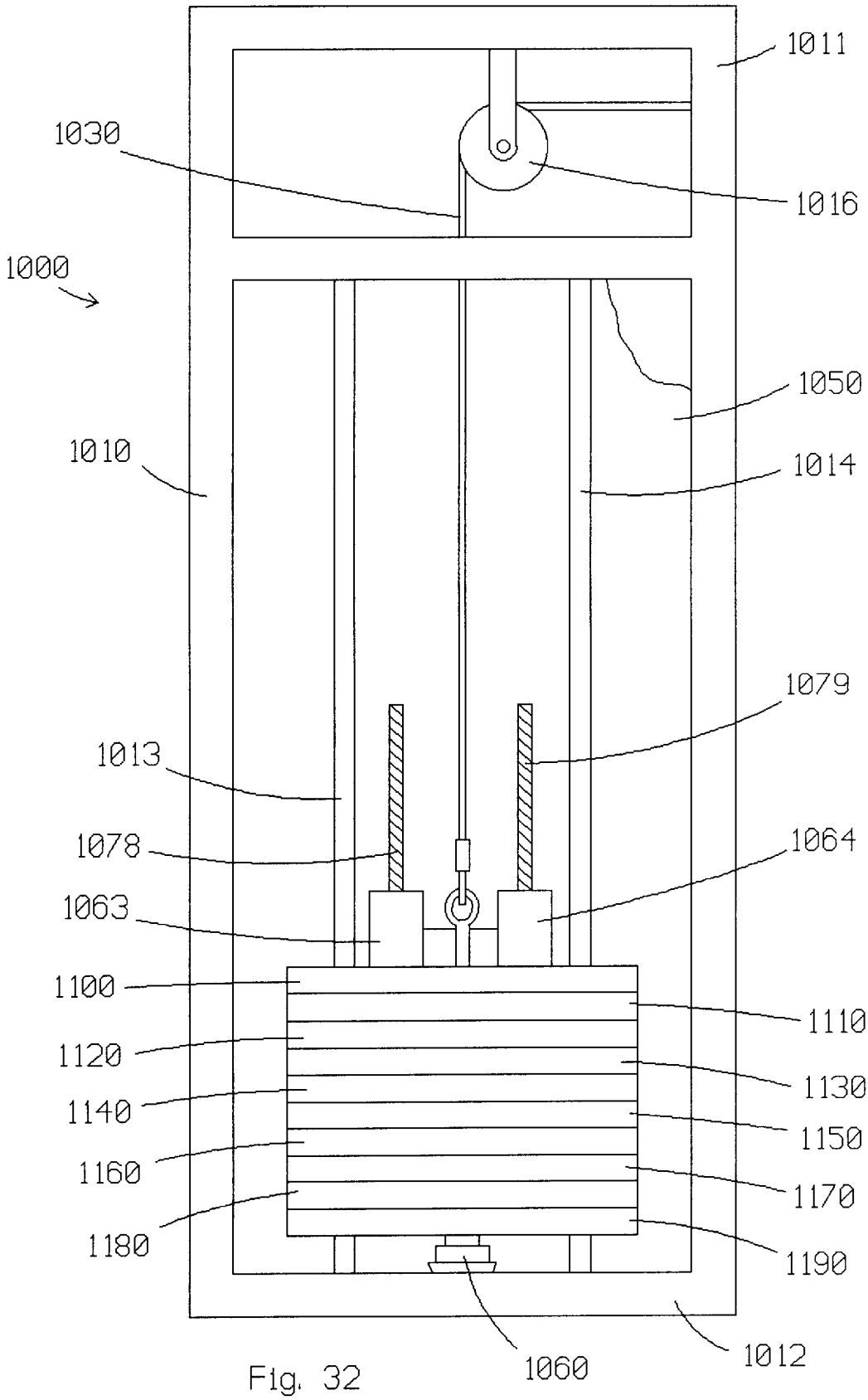
FIG. 32 is partially sectioned front view of another weight stack exercise apparatus constructed according to the principles of the present invention.

Still another weight stack exercise apparatus constructed according to the principles of the present invention is designated as 1000 in FIG. 32. The exercise apparatus 1000 includes a frame 1010 having an upper end 1011 and a lower end 1012, with guide members or rods 1013 and 1014 extending vertically therebetween. The guide rods 1013 and 1014 extend through holes 1103 and 1104 (see FIGS. 33–34), respectively, in each of the weight stack plates 1100, 1110, 1120, 1130, 1140, 1150, 1160, 1170, 1180, and 1190 to maintain alignment of the weight stack. A fastener 1102 extends upward from the uppermost weight 1100, and a cable 1030 extends upward from the fastener 1102. The cable 1030 is routed about a pulley 1016 and proceeds to a force receiving member of any type known in the art. A shock-absorbing bumper 1060 is disposed beneath the weight stack to absorb impact from descending weights. A unitary protective shield 1050 may be secured across the entire side of the frame 1010 and function as a partition and/or shroud between the stack of weights and any people in the vicinity of the apparatus 1000.

Figure 33:
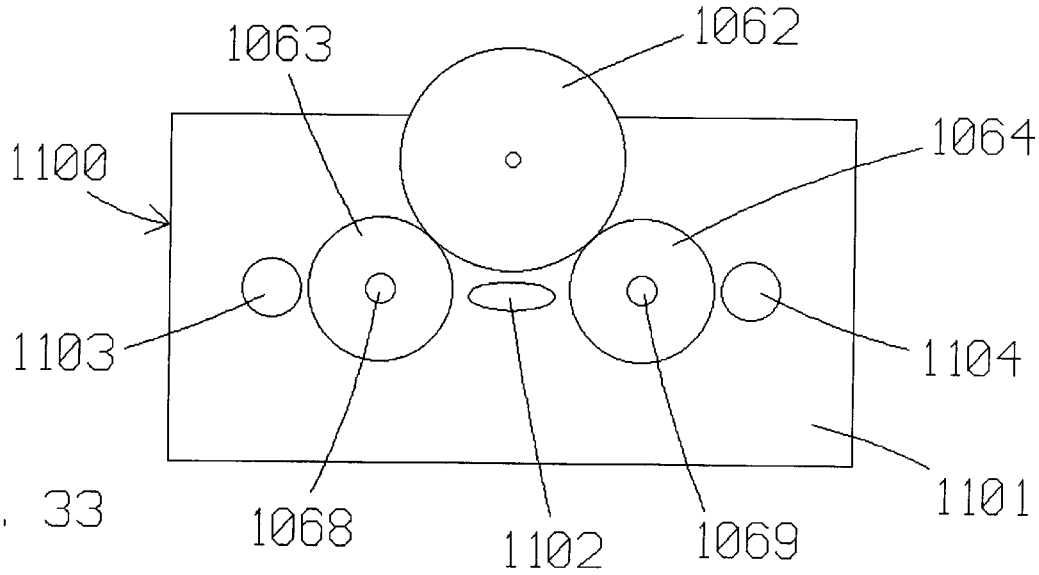
FIG. 33 is a top view of a weight adjustment assembly and uppermost weight on the apparatus of FIG. 32.
Figure 34:
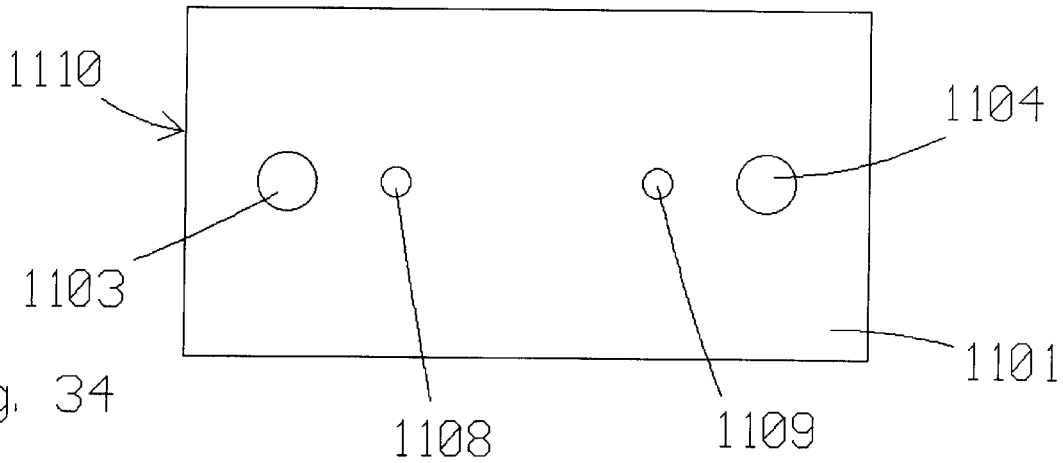
FIG. 34 is a top view of another weight on the apparatus of FIG. 32.

As shown in FIG. 33, a motor driven roller 1062 is rotatably mounted on the uppermost weight stack plate 1100 together with rollers 1063 and 1064. Threaded holes 1068 and 1069 are formed through respective rollers 1063 and 1064 to mate with exterior threads on respective shafts 1078 and 1079. As shown in FIG. 34, threaded holes 1108 and 1109 are formed through each of the weights 1101 to likewise receive respective shafts 1078 and 1079. Rotation of the motor driven roller 1062 causes rotation of the rollers 1063 and 1064, thereby moving the shafts 1078 and 1079 downward or upward, into or out of engagement with the threaded holes 1108 and 1109 in any number of weight stack plates. Interengaging gear teeth may be provided at the interfaces between the rollers 1063 and 1064 and the motor driven roller 1062 to facilitate rotational transmission therebetween.

Figure 35:
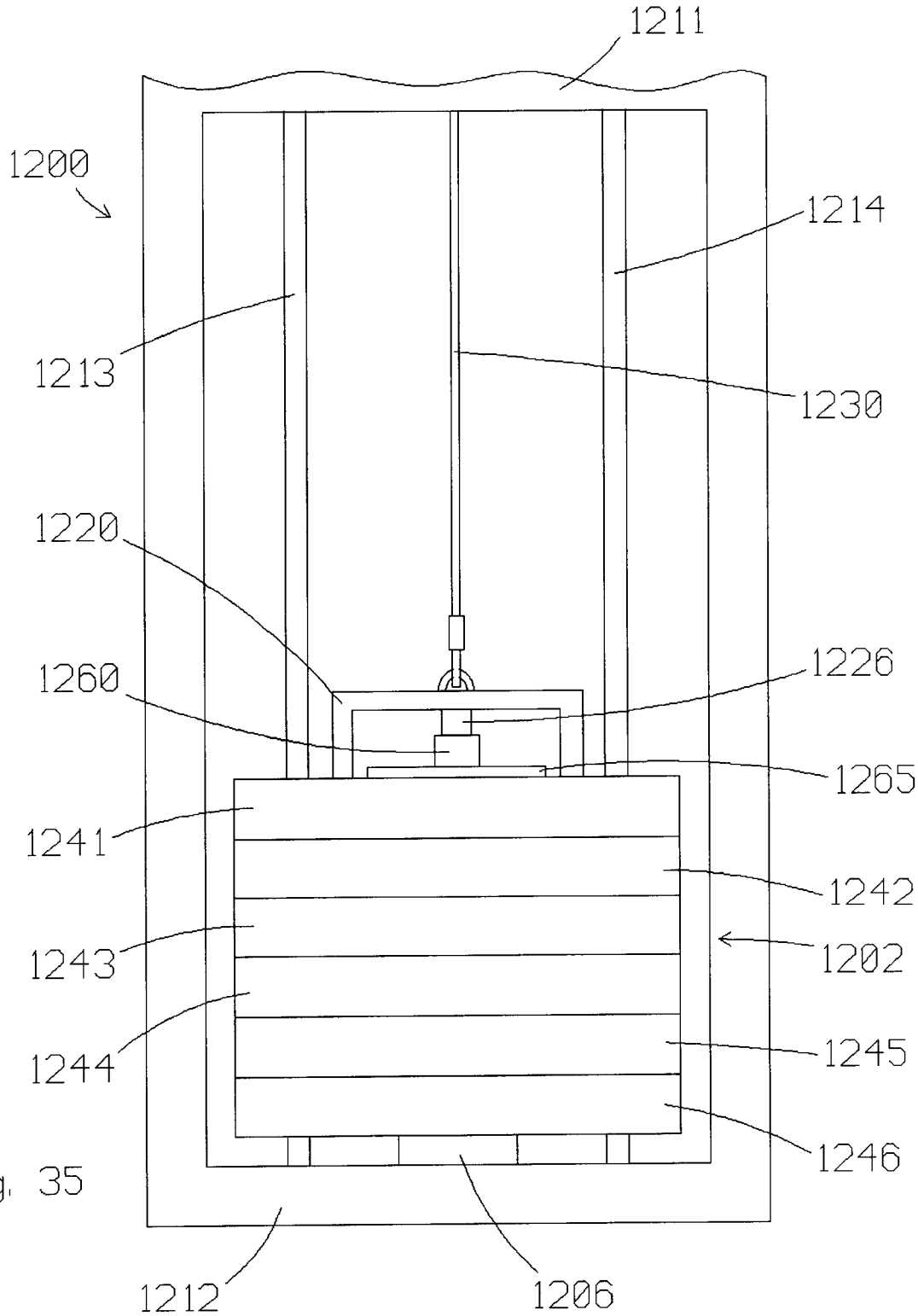
FIG. 35 is a fragmented front view of yet another weight stack exercise apparatus constructed according to the present invention.

FIG. 35 shows a weight stack exercise apparatus 1200 which combines aspects of the previous embodiment 1000 and the weight stack shown in FIG. 24. A weight stack 1202 is supported by a pair of guide rods 1213 and 1214 which extend between an upper frame portion 1211 and a lower frame portion 1212. A shock absorbing bumper 1206 is disposed between the weight stack 1202 and the lower frame portion 1212. A bracket 1220 is secured to the uppermost weight stack plate 1241, and an end of a flexible connector 1230 is secured to the bracket 1220. An opposite end of the connector 1230 is connected to a force receiving member (not shown).

A selector rod 1260 is rotatably mounted to the uppermost weight stack plate 1241. The selector rod 1260 selectively engages the weights 1241–1246 in the stack 1202 in much the same manner as the selector rod 610 cooperates with the weight stack shown in FIG. 24. A shaft 1226 is rigidly secured to the bracket 1220 and extends downward into the selector rod 1260 to keep the latter in alignment with the weight stack 1202. A plate 1265 is rigidly secured to the selector rod 1260 to transmit the weight of the rod 1260 and any engaged lower weights 1242–1246 to the uppermost weight 1241.

Figure 36:
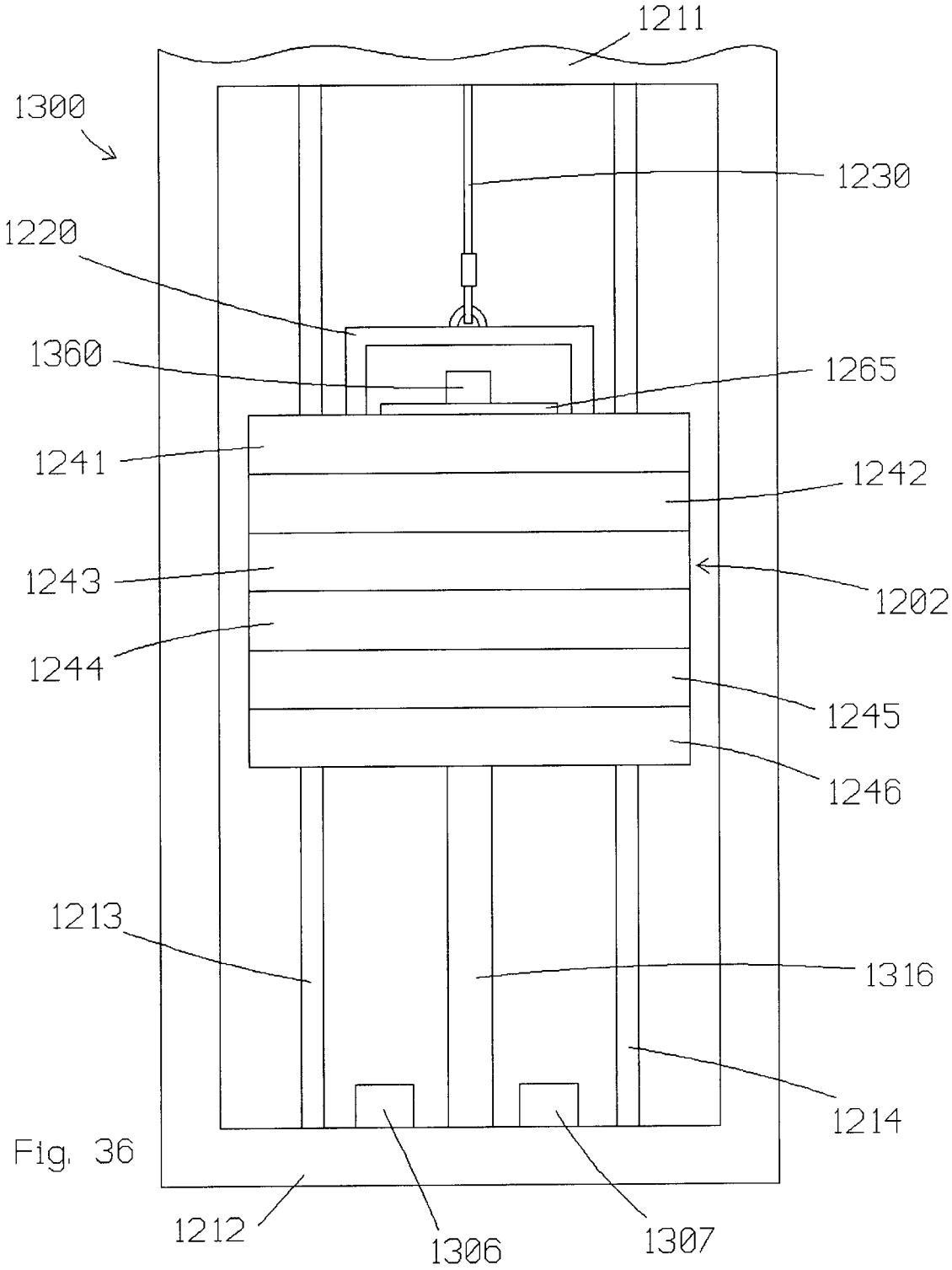
FIG. 36 is a fragmented front view of still another weight stack exercise apparatus constructed according to the present invention.

FIG. 36 shows an exercise apparatus 1300 similar in many respects to the foregoing embodiment 1200, as suggested by the common reference numerals. However, a pair of shock absorbing bumpers 1306 and 1307 are substituted for the shock absorbing bumper 1206, and a frame mounted shaft 1316 is provided to keep the selector rod 1360 in alignment with the weight stack 1202. The shaft 1316 preferably includes spring-biased, telescoping sections to accommodate upward travel of the weights 1241–1246 over a distance greater than the height of the stack 1202.

Figure 37:
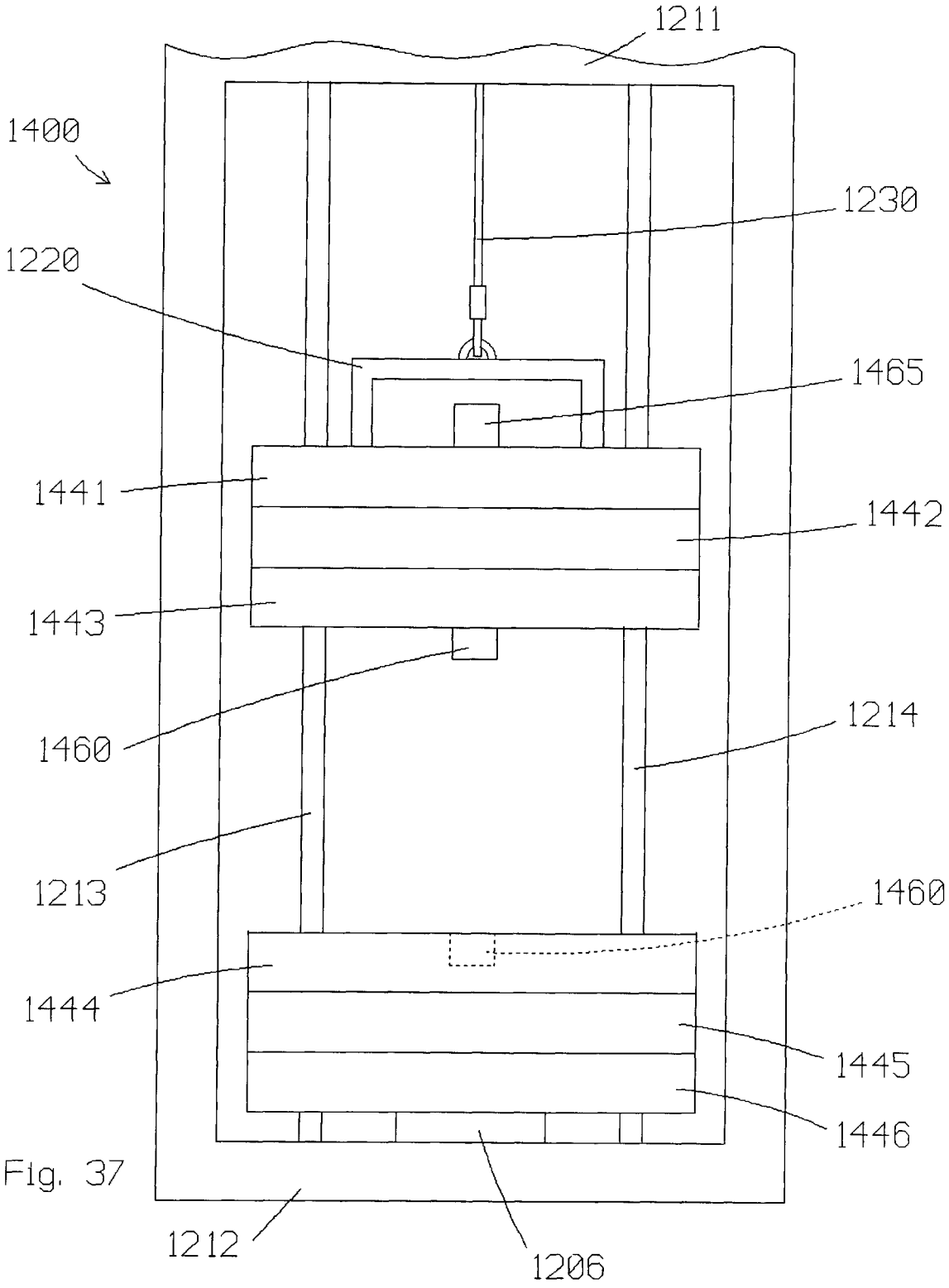
FIG. 37 is a fragmented front view of one more weight stack exercise apparatus constructed according to the present invention.

FIG. 37 shows an exercise apparatus 1400 similar in some respects to the foregoing embodiments 1200 and 1300, as suggested by the common reference numerals. However, a stack of different weights 1441–1446 has been substituted for the weight stack 1202. In particular, each of the weights 1441–1445 has its own centrally mounted selector rod 1460 which is selectively rotatable into and out of engagement with its counterpart on an underlying weight stack plate. In particular, each selector rod 1460 has an upper portion and a lower portion, and the former is sized and configured to receive the latter. For example, the lower portion of the selector rod 1460 on the third highest plate 1443 protrudes downward beneath the plate 1443 and into engagement with an upper portion of the selector rod on the fourth highest plate 1444.

A knob 1465 is secured to the upper portion of the selector rod 1460 on the uppermost plate 1441 to facilitate selection of the desired number of plates. Rotation of the knob 1465 a first amount in a first direction causes the uppermost selector rod 1460 to engage the second highest selector rod 1460. Rotation of the knob 1465 an additional amount in the first direction causes the next highest selector rod 1460 to engage the third highest selector rod 1460, and so on. Rotation of the knob 1465 as far as allowed in a second, opposite direction ensures that all of the selector rods 1460 are disengaged from one another. The likelihood of engaging a relatively lower weight prematurely may be reduced by impeding rotation of the selector rods 1460.

Figure 38:
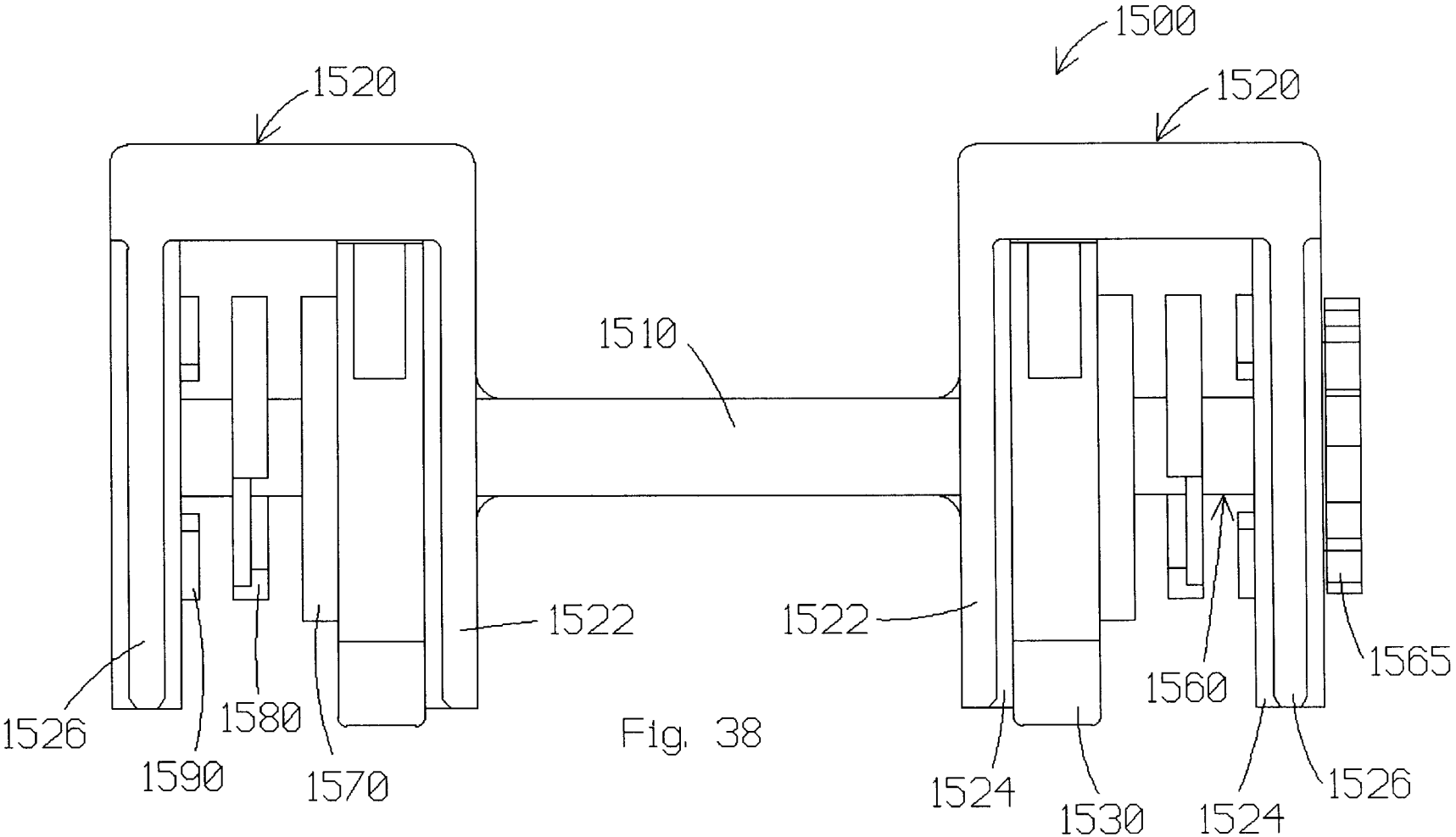
FIG. 38 is a side view of an exercise dumbbell constructed according to the principles of the present invention.
Figures 54, 55, 56:
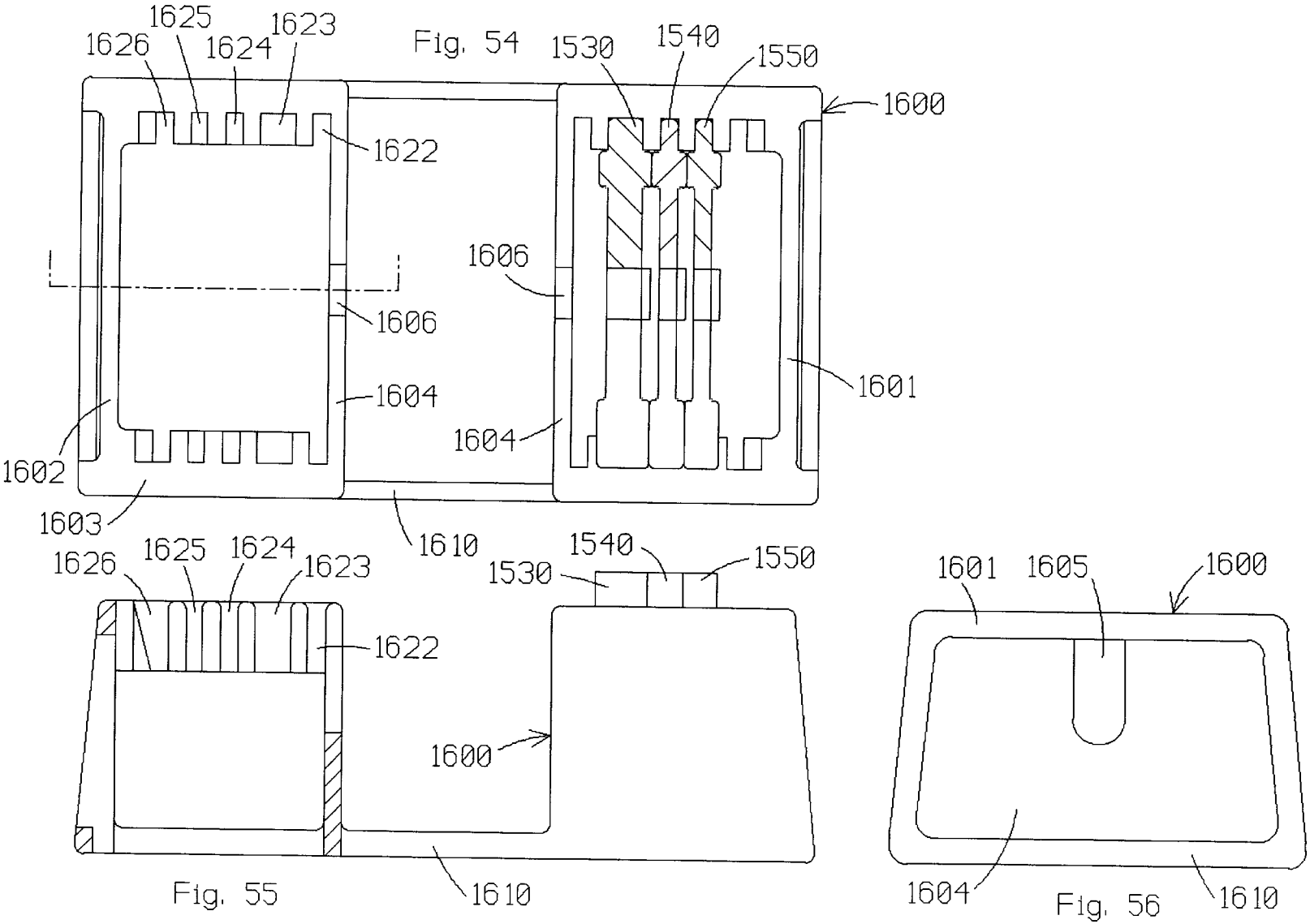
FIG. 54 is a partially sectioned top view of the weights of FIG. 50 resting on a cradle constructed according to the principles of the present invention.
FIG. 55 is a partially sectioned side view of the weights and cradle of FIG. 54.
FIG. 56 is an end view of the cradle of FIG. 54 without the weights.

Yet another embodiment of the present invention is designated as 1500 in FIG. 38. The exercise apparatus 1500 is a dumbbell having an intermediate handle 1510, which is sized and configured for grasping, and opposite end weight housings 1520, which are sized and configured to accommodate respective weight plates 1530, 1540, and 1550. When not in use, the supports 1520 and the weight plates 1530, 1540, and 1550 rest on a base or cradle designated as 1600 in FIGS. 54–56. Other suitable weight supporting arrangements are disclosed in U.S. Pat. No. 4,529,198 to Hettick, Jr.; U.S. Pat. No. 4,822,034 to Shields; U.S. Pat. No. 5,284,463 to Shields; U.S. Pat. No. 5,637,064 to Olson et al.; U.S. Pat. No. 5,769,762 to Towley, III et al.; and U.S. Pat. No. 5,839,997 to Roth et al., all of which are incorporated herein by reference, together with Applicant's co-pending U.S. patent application Ser. No. 08/939,845, filed on Sep. 29, 1997, and U.S. patent application Ser. No. 09/246,825, filed on Feb. 8, 1999.

Figure 39:
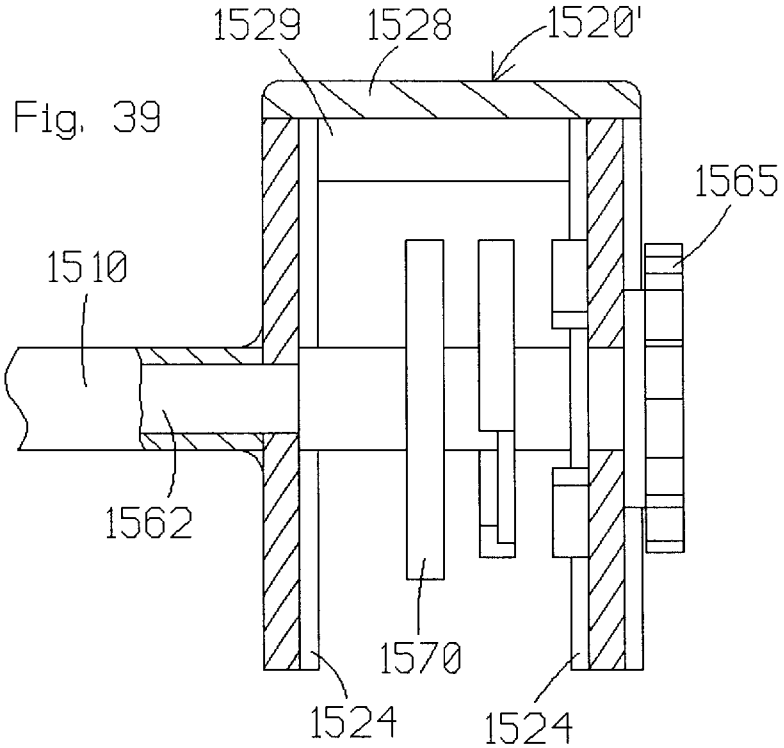
FIG. 39 is partially sectioned side view of one end of the dumbbell of FIG. 38.
Figure 42:
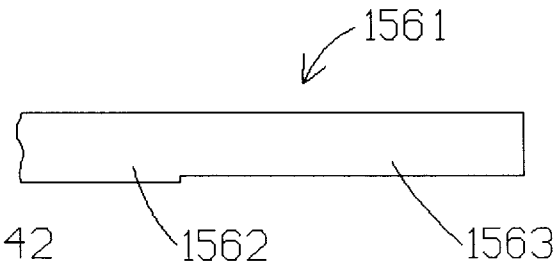
FIG. 42 is a side view of one end of a shaft on the dumbbell of FIG. 38.

The handle 1510 is a cylindrical tube having a longitudinal 15 axis and opposite ends secured to respective housings 1520 by welding or other suitable means. Each of the housings 1520 includes an inside end wall 1522, an outside end wall 1526, a top wall 1528, and opposite side walls 1529, which cooperate to define a downwardly opening compartment. FIG. 38 shows integrally molded housings 1520, and FIG. 39 shows a housing 1520' which is identical in size and configuration, but assembled from three discrete parts. In either case, spacers could extend downward from the top wall 1528 to occupy axial spaces between the weight plates 1530, 1540, and 1550. Axially offset shoulders 1524 are provided on interior, diametrically opposed sides of each end wall 1522 and 1526 to engage respective weights 1530 and 1550 and provide centrally located gaps therebetween. The shoulders 1524 are disposed inward from the outside edges of the walls 1522 and 1526.

A selector rod 1560 is rotatably mounted relative to both the handle 1510 and the housings 1520. The selector rod 1560 includes a shaft 1561 and two sets of weight engaging members or supports 1570, 1580, and 1590 mounted on the shaft 1561. The shaft 1561 includes an intermediate portion 1562 having a circular profile, and opposite end portions 1563 having clipped circular profiles (a flat surface is cut into an otherwise circular profile). The intermediate portion 1562 extends through the handle 1510 and through the inside end wall 1522 of each housing 1520. Each end portion 1563 extends through a respective housing 1520 and through a respective outside end wall 1526.

Figure 44:
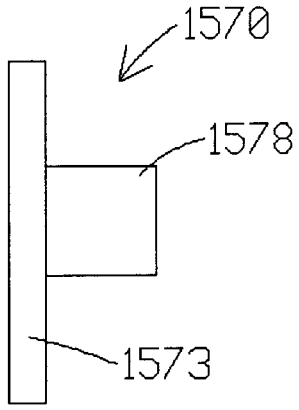
FIG. 44 is a side view of a first weight engaging member on the dumbbell of FIG. 38.
Figure 45:
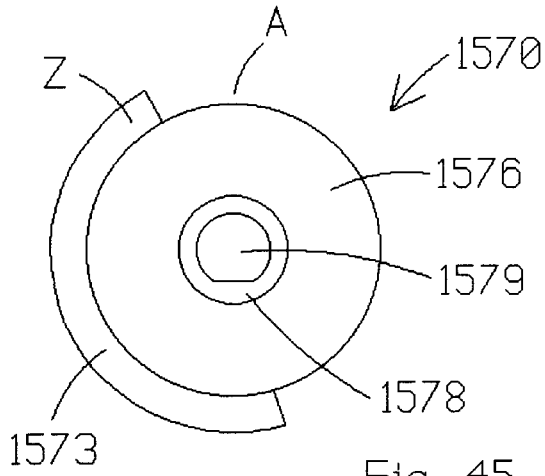
FIG. 45 is an end view of the weight engaging member of FIG. 44.

The innermost weight support 1570 is shown by itself in FIGS. 44–45. The support 1570 includes an axially extending hub 1578, a radially extending rim 1576, and an axially extending lip 1573. The support 1570 is a single piece of integrally molded plastic, and thus, the rim 1576 may be said to be integrally connected between the lip 1573 and the hub 1578. An opening 1579, sized and configured to receive an end 1563 of the shaft 1561, extends through the hub 1578 and the rim 1576. The lip 1573 includes a single, continuous segment which extends through an arc of 167.5° The single segment spans a sector designated as Z in FIG. 45, but it does not span the sector designated as A.

Figure 46:
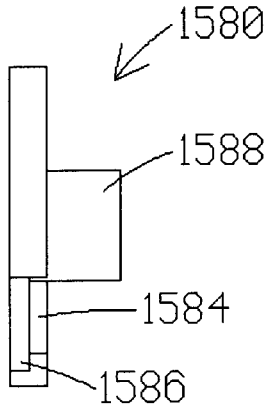
FIG. 46 is a side view of a second weight engaging member on the dumbbell of FIG. 38.
Figure 47:
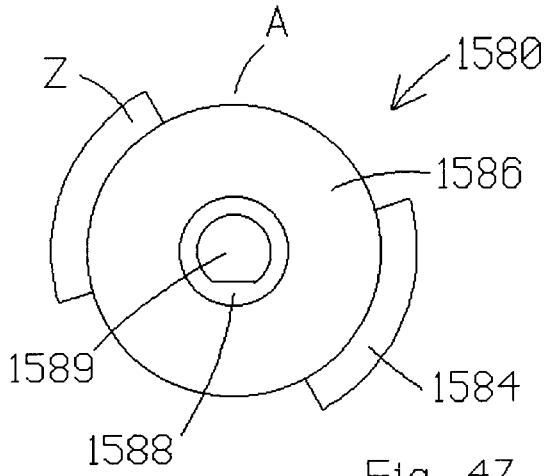
FIG. 47 is an end view of the weight engaging member of FIG. 46.

The intermediate weight support 1580 is shown by itself in FIGS. 46–47. The support 1580 includes an axially extending hub 1588, a radially extending rim 1586, and an axially extending lip 1584. The support 1580 is a single piece of integrally molded plastic, and thus, the rim 1586 may be said to be integrally connected between the lip 1584 and the hub 1588. An opening 1589, sized and configured to receive an end 1563 of the shaft 1561, extends through the hub 1588 and the rim 1586. The lip 1584 includes two diametrically opposed segments which extend through respective arcs of 77.5° One of the segments spans the sector designated as Z in FIG. 47, but neither of the segments spans the sector designated as A.

Figure 48:
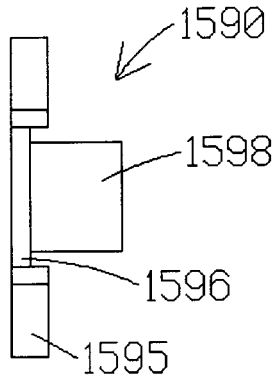
FIG. 48 is a side view of a third weight engaging member on the dumbbell of FIG. 38.
Figure 49:
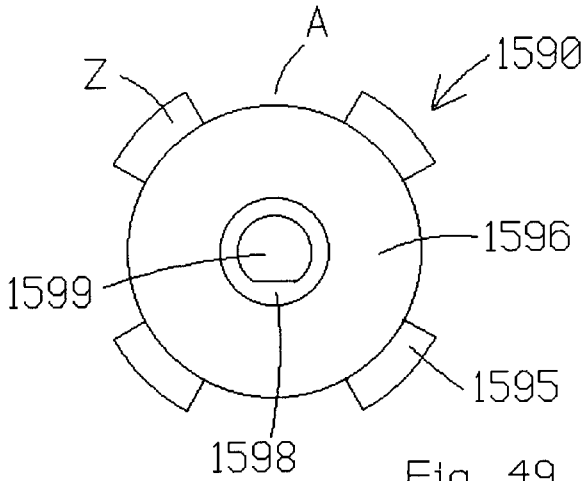
FIG. 49 is an end view of the weight engaging member of FIG. 48.
Figure 50:
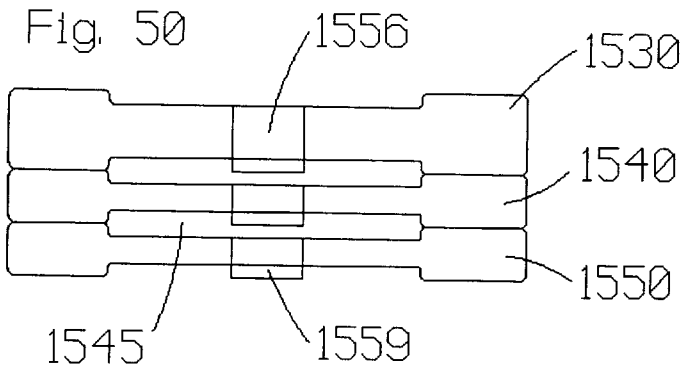
FIG. 50 is a top view of three adjacent weights on the dumbbell of FIG. 38.

The outermost weight support 1590 is shown by itself in FIGS. 48–49. The support 1590 includes an axially extending hub 1598, a radially extending rim 1596, and an axially extending lip 1594. The support 1590 is a single piece of integrally molded plastic, and thus, the rim 1596 may be said to be integrally connected between the lip 1595 and the hub 1598. An opening 1599, sized and configured to receive an end 1563 of the shaft 1561, extends through the hub 1598 and the rim 1596. The lip 1595 includes four circumferentially spaced segments which extend through respective arcs of 32.5° One of the segments spans the sector designated as Z in FIG. 49, but none of the segments spans the sector designated as A.

Figure 41:
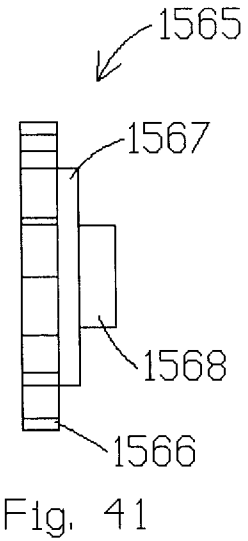
FIG. 41 is an opposite side view of the knob of FIG. 40.
Figure 40:
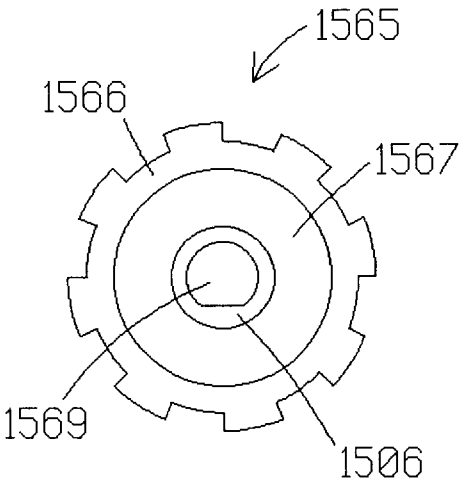
FIG. 40 is an end view of a knob on the dumbbell of FIG. 38.
Figure 43:
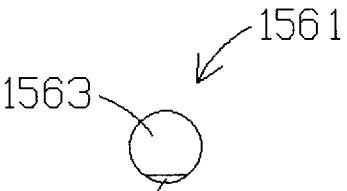
FIG. 43 is an end view of the shaft of FIG. 42.

A fastener is fastened to one end 1563 of the shaft 1561, just beyond the outside end wall 1526, and a knob 1565 is fastened to an opposite end 1563 of the shaft 1561 just beyond the opposite, outside end wall 1526. As shown in FIGS. 40–41, the knob 1565 includes a relatively large diameter rim 1566 which is sized and configured for grasping, an intermediate portion 1567 which bears against the outside end wall 1526, and a relatively small diameter hub 1568 which extends through the outside end wall 1526. A recess 1506 is provided in the hub 1568 to receive a fastener in countersunk fashion. Both the knob 1565 and the supports 1570, 1580, and 1590 rotate together with the shaft 1561 relative to the housings 1520 and the handle 1510.

Figure 51:
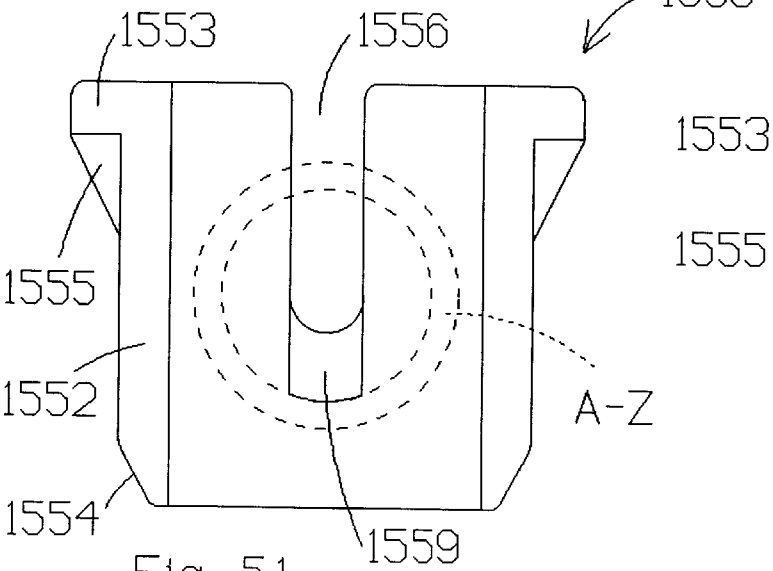
FIG. 51 is an end view of one of the weights shown in FIG. 50.
Figure 52:
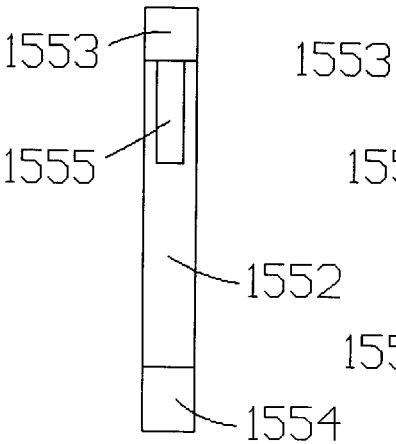
FIG. 52 is a side view of the weight of FIG. 51.
Figure 53:
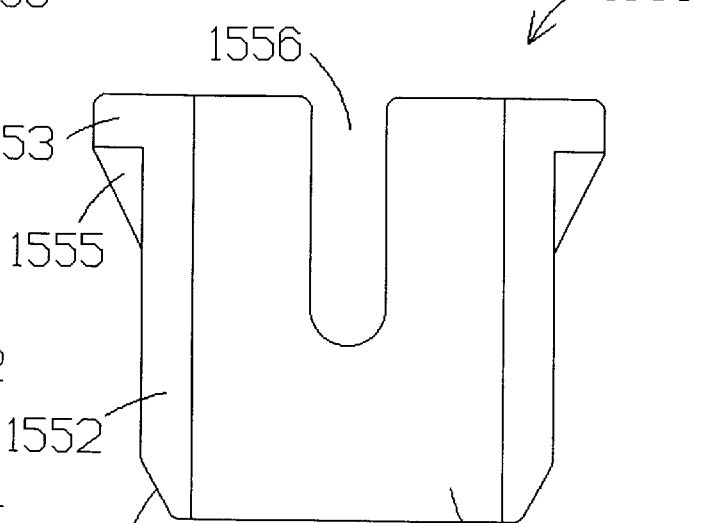
FIG. 53 is an opposite end view of the weight of FIG. 51.

The weight plates 1530, 1540, and 1550 are shown in greater detail in FIGS. 50–53. Although the two plates 1540 and 1550 are shown with the same thickness, the plate 1550 is one-half as dense and thus, weighs one-half as much as the plate 1540, which in turn, weighs one-half as much as the plate 1530. The end views of the plate 1550 shown in FIGS. 51 and 53 are representative of the end views of the other plates 1540 and 1530.

Each side of the plate 1550 (and the plates 1540 and 1530) may be described with reference to a relatively thinner, intermediate portion 1551 and relatively thicker, opposite side portions 1552. The side portions 1552 bear against adjacent counterparts and/or against shoulders 1524 on respective end walls 1522 or 1526, and the intermediate portion 1551 cooperates with adjacent counterparts and/or the end walls 1522 or 1526 to define gaps 1545 disposed between the side portions 1552 and the shoulder 1524. The gaps 1545 are sized and configured to receive respective weight supports 1570, 1580, and 1590. FIG. 51 shows how the plates 1550, 1540, and 1530 axially align with the supports 1590, 1580, and 1570.

An elongate slot 1556, sized and configured to accommodate the axial hub 1598, 1588, or 1578 of a respective support 1590, 1580, or 1570 extends downward into each of the plates 1550, 1540, and 1530. Immediately beneath the slot 1556, a peg 1559 projects axially outward from the intermediate portion 1551 of the plate 1550 (and each of the plates 1540 and 1530). The peg 1559 is disposed just inside the path A-Z traveled by the axially extending lip 1595 on the support 1590. When a segment of the lip 1595 is disposed beneath the peg 1559, the plate 1550 is constrained to move upward together with the handle 1510.

The upper ends of the side portions 1552 terminate in respective laterally extending portions 1553, which extend away from one another. The lateral portions 1553 are the same thickness as the side portions 1552. The lower ends 1554 of the side portions 1552 are beveled or tapered. Relatively thinner, triangular fins 1555 extend. between respective lateral portions 1553 and respective side portions 1552. The fins 1555 are sized and configured to fit within opposing slots 1625 in the base 1600, and the lateral portions 1553 are designed to rest on top of the ledge 1603. Similar fins 1555 on the plates 1540 and 1530 are sized and configured to fit within respective slots 1624 and 1623 in the base 1600. The grooves 1623–1625 are bounded by inclined, opposing walls which cooperate to center the plates 1530, 1540, and 1550 relative to the base 1600. Additional grooves 1622 and 1626 are provided in the base 1600 to receive the end walls 1522 and 1526, respectively. The grooves 1626 are bounded by relatively outward walls which are inclined upward and away from the middle of the base 1600.

The base 1600 includes a bottom 1610 sized and configured to rest upon a flat surface, such as a table top or floor. Opposite end portions 1601 and 1602 extend upward from the bottom 1610. In addition to outside walls, interior walls 1604 extend upward from the bottom 1610 and between opposing end walls 1522 on respective housings 1520. Elongate slots 1606 extend downward into the interior walls 1604 to accommodate the handle 1510. When the plates 1530, 1540, and 1550 are suspended from the base 1600, the slots 1606 align with the slots 1556.

The supports 1570, 1580, and 1590 are designed for rotation in 45° increments. A ball detent or other known biasing system may be interconnected between the housing 1520 and either the knob 1565 or the shaft selector rod 1560, for example, to bias the selector rod 1560 toward the desired orientations. The lips 1573, 1584, and 1595 are configured to provide clearance or tolerance vis-a-vis the pegs 1559. In particular, when any given plate 1530, 1540, or 1550 is not engaged, the respective lip 1573, 1584, or 1595 is at least 6.5° outside the boundary of the peg 1559. With reference to the support 1590, for example, each of the lip segments 1595 spans an arc of 32.5°.

The configurations of the plates 1530, 1540, and 1550 and the weight supports 1570, 1580, and 1590 are such that any combination of the plates 1530, 1540, and 1550 may be secured to the handle 1510 for removal from the base 1600. In this regard, when the supports 1570, 1580, and 1590 occupy the respective orientations shown in FIGS. 45, 47, and 49, the plate 1530 is engaged to the exclusion of the plates 1540 and 1550. When the supports 1570, 1580, and 1590 are rotated 180°, the sector designated as A underlies the pegs 1559 on the plates 1530, 1540, and 1550, and none is secured to the handle 1510. When the supports 1570, 1580, and 1590 are rotated until the sector designated as Z underlies the pegs 1559, all of the plates 1530, 1540, and 1550 are engaged.

Assuming that the handle 1510 and the housings 1520 collectively weigh ten pounds, and the plates 1530, 1540, and 1550 weigh ten pounds, five pounds, and two and one-half pounds, respectively, the following chart shows how different amounts of weight may be selected as a function of the orientation of the selector rod 1560.

| Rod | Handle | Weights 1550 | Weights 1540 | Weights 1530 | Total |
|---|---|---|---|---|---|
| — | 10 | 0 | 0 | 0 | 10 |
| 45° | 10 | 5 | 0 | 0 | 15 |
| 90° | 10 | 0 | 10 | 0 | 20 |
| 135° | 10 | 5 | 10 | 0 | 25 |
| 180° | 10 | 0 | 0 | 20 | 30 |
| 225° | 10 | 5 | 0 | 10 | 35 |
| 270° | 10 | 0 | 10 | 20 | 40 |
| 315° | 10 | 5 | 10 | 20 | 45 |
| 360° | 10 | 0 | 0 | 0 | 10 |

An advantage of this embodiment 1500 is that only three discrete weights are required on each side of the dumbbell to provide eight different balanced dumbbell loads. Moreover, the number of available dumbbell loads may be doubled by adding two "half-weights" which weigh one-half as much as the plates 1550. For example, half-weights could be connected to the inside end walls 1522 by means of hook and loop fasteners.

Another advantage of the dumbbell 1500 is that it can be manufactured relatively efficiently, especially as compared to the dumbbell disclosed in U.S. Pat. No. 5,839,997 to Roth et al. For example, the relatively gross, "over/under" relationship between the weight supports and the weights imposes less stringent requirements on the manufacturing process. In other words, the weight supports 1570, 1580, and 1590 are relatively simple parts which may be injection molded, and the weights 1530, 1540, and 1550 are relatively simple parts which may be cast.

The present invention may also be described in terms of a method of providing adjustable resistance to exercise, involving the provision of a plurality of aligned weights; the provision of a selector rod having a discrete weight support for each of the weights; and the rotation of the selector rod relative to the weights until a respective weight support underlies each desired weight. This method may further involve providing holes through the weights (or slots in the weights) to receive the selector rod; having the selector rod occupy all such holes (or slots) during rotation, regardless of which weights are the desired weight; rotating the selector rod a fraction of a revolution to engage an additional weight; threading the selector rod into engagement with the desired weights; compressing the desired weights; and/or rotating the selector rod about its longitudinal axis until a radially extending pin (or an axially extending lip) underlies a portion of each desired weight.

The present invention may also be described as a method of adjusting resistance to exercise, involving the provision of a plurality of aligned weights; the provision of a selector rod having a discrete weight support for each of the weights; rotation of the selector rod a first amount relative to the weights to engage a first weight; and rotation of the selector rod a second amount relative to the weights to engage a second weight. This method may further involve threading the selector rod into each desired weight; clamping all the engaged weights together; rotating the selector rod about its longitudinal axis until a radially extending pin (or an axially extending lip) underlies a portion of the second weight; and/or rotating the selector rod a first amount to engage only the first weight, a second amount to engage only the second weight, and a third amount to engage both the first weight and the second weight.

For reasons of practicality, the foregoing description and accompanying figures are necessarily limited to only some of the many conceivable embodiments to be constructed in accordance with the principles of the present invention. Other embodiments, methods, and/or modifications will become apparent to those skilled in the art as a result of this disclosure. Moveover, those skilled in the art will also recognize that aspects and/or features of various methods and/or embodiments may be mixed and matched in numerous ways to arrive at still more variations of the present invention. In views of the foregoing, the scope of the present invention is to be limited only to the extent of the following claims.

What is claimed is:

1. A method of providing adjustable resistance to exercise, comprising the steps of:

providing a selector rod with a shaft having a longitudinal axis, and with axially spaced members fastened to the shaft and extending radially away from the shaft, so that the shaft and the members are constrained to move together as a unitary part;

providing a plurality of aligned weights with openings sized and configured to accommodate the shaft, and gaps disposed between adjacent weights to accommodate respective members;

moving the selector rod downward into the openings in a manner which aligns each of the members with a respective one of the gaps;

rotating the selector rod relative to the weights until respective members underlie desired ones of the weights; and moving the selector rod upward together with the desired ones of the weights.

2. The method of claim 1, wherein the selector rod is moved axially into the openings in the weights.

3. The method of claim 1, wherein the weights are aligned in a vertical stack.

4. The method of claim 1, wherein the weights are provided with openings bounded by uninterrupted, cylindrical side walls.

5. The method of claim 1, wherein each of the weights is provided with an axially extending nub, and each of the members is provided with an axially extending lip that is selectively rotatable between a first orientation disposed beneath a respective nub, and a second orientation disposed above the respective nub.

6. The method of claim 1, wherein the weights are aligned side by side in two axially spaced horizontal stacks, and the selector rod is rotatable to a first orientation relative to the weights, wherein only first weights in respective stacks are engaged by respective members, and the selector rod is rotatable to a second orientation relative to the weights, wherein only second weights in respective stacks are engaged by respective members.

7. The method of claim 6, wherein the selector rod is rotatable to a third orientation relative to the weights, wherein both said first weights and said second weights are engaged by respective members.

8. The method of claim 1, wherein each of the members is provided with an axially extending offset, an axially extending lip, and a radially extending flange interconnected between the lip and the offset, and each of the weights is provided with an axially extending nub which is disposed radially inward from a respective lip when the selector rod is axially aligned with the openings in the weights.

9. The method of claim 8, wherein each said lip is provided with a segment which spans a common first sector, and each said lip is provided with a void at a common second sector.

10. The method of claim 8, wherein at least one of the members is provided with a lip divided into at least two separate, circumferentially spaced segments.

11. The method of claim 1, wherein the weights are provided with openings bounded by U-shaped side walls.

12. The method of claim 1, wherein at least one of the members is provided with an axially extending lip divided into four separate, circumferentially spaced segments, and a void is defined between each of the segments, and rotation of the selector rod relative to the weights alternatively moves one of the segments and then an adjacent void beneath a respective one of the weights.

13. The method of claim 1, wherein the selector rod is rotatably mounted on a base, and further comprising the step of providing a handle on the base.

14. The method of claim 13, wherein the handle has a longitudinal axis, and the handle and the selector rod are arranged to extend parallel to one another.

15. The method of claim 13, wherein the handle has a longitudinal axis, and the handle and the selector rod are arranged co-axially relative to one another.

16. The method of claim 1, wherein the weights are provided with axially protruding shoulders that extend between adjacent weights and bound opposite sides of respective gaps.

17. The method of claim 1, wherein each of the members is provided with a radial portion that extends radially away from the shaft, and an axial portion that extends axially away from the radial portion at a radial distance apart from the shaft.

18. The method of claim 1, wherein the members are configured and fastened to the shaft in such a manner that at least two of the members occupy discrete axial locations along the shaft and have respective portions that occupy mutually exclusive orientations relative to the axis.

19. The method of claim 18, wherein the members are configured and fastened to the shaft in such a manner that at least two of the members occupy discrete axial locations along the shaft and have respective portions that occupy a common orientation relative to the axis.

20. The method of claim 1, wherein the members are configured and fastened to the shaft in such a manner that at least two of the members occupy discrete axial locations along the shaft and have respective portions that occupy a common orientation relative to the axis.

21. The method of claim 1, wherein the members are configured and fastened to the shaft in such a manner that at least two of the members occupy discrete axial locations along the shaft and have respective first portions that occupy a common orientation relative to the axis, and respective second portions that occupy mutually exclusive orientations relative to the axis.

22. A method of providing adjustable resistance to exercise, comprising the steps of:

providing a selector rod with a shaft having a longitudinal axis, and axially spaced members extending radially away from the shaft, wherein the shaft and the members are provided for movement as a unitary part;

providing a plurality of aligned weights with openings sized and configured to accommodate the shaft, and gaps disposed between adjacent weights to accommodate respective members;

moving the selector rod downward into the openings in a manner which aligns each of the members with a respective one of the gaps, wherein the selector rod is moved radially into the openings in the weights;

rotating the selector rod relative to the weights until respective members underlie desired ones of the weights; and moving the selector rod upward together with the desired ones of the weights.

23. The method of claim 22, wherein the weights are provided with axially protruding shoulders that extend between adjacent weights and bound opposite sides of respective gaps.

24. The method of claim 22, wherein each of the weights is provided with an axially extending nub, and each of the members is provided with an axially extending lip that is selectively rotatable between a first orientation disposed beneath a respective nub, and a second orientation disposed above the respective nub.

25. The method of claim 22, wherein one of the members is provided with a first axially extending lip having a first configuration, and another of the members is provided with a second axially extending lip having a discrete, second configuration, and the selector rod is rotatable from a first orientation, wherein only said first axially extending lip underlies a respective one of the weights, and a second orientation, wherein each said axially extending lip underlies a respective one of the weights.

26. A method of providing adjustable resistance to exercise, comprising the steps of:

providing a selector rod with a shaft having a longitudinal axis, and axially spaced members extending radially away from the shaft, wherein the shaft and the members are provided for movement as a unitary part;

providing a plurality of aligned weights with openings sized and configured to accommodate the shaft, and gaps disposed between adjacent weights to accommodate respective members, wherein the weights are aligned in at least one horizontal stack;

moving the selector rod downward into the openings in a manner which aligns each of the members with a respective one of the gaps;

rotating the selector rod relative to the weights until respective members underlie desired ones of the weights; and moving the selector rod upward together with the desired ones of the weights.

27. The method of claim 26, wherein the selector rod is moved radially into the openings in the weights.

28. The method of claim 26, wherein the weights are provided with axially protruding shoulders that extend between adjacent weights and bound opposite sides of respective gaps.

29. The method of claim 26, wherein each of the weights is provided with an axially extending nub, and each of the members is provided with an axially extending lip that is selectively rotatable between a first orientation disposed beneath a respective nub, and a second orientation disposed above the respective nub.

30. The method of claim 26, wherein one of the members is provided with a first axially extending lip having a first configuration, and another of the members is provided with a second axially extending lip having a discrete, second configuration, and the selector rod is rotatable from a first orientation, wherein only said first axially extending lip underlies a respective one of the weights, and a second orientation, wherein each said axially extending lip underlies a respective one of the weights.

* * * * *